US005807030A

United States Patent [19]

Anderson et al.

[11] Patent Number: 5,807,030

[45] Date of Patent: Sep. 15, 1998

[54] STABILIZING ELEMENTS FOR MECHANICALLY STABILIZED EARTHEN STRUCTURE

[75] Inventors: Peter L. Anderson, North Reading, Mass.; Michael J. Cowell, Leesburg; Dan J. Hotek, Front Royal, both of Va.

[73] Assignee: The Reinforced Earth Company, Vienna, Va.

[21] Appl. No.: 472,885

[22] Filed: Jun. 7, 1995

Related U.S. Application Data

[63] Continuation-in-part of Ser. No. 40,904, Mar. 31, 1993, Pat. No. 5,507,599, and a continuation-in-part of Ser. No. 108, 933, Aug. 18, 1993, Pat. No. 5,487,623, and a continuation-in-part of Ser. No. 137,585, Oct. 15, 1993, Pat. No. 5,474, 405, and a continuation-in-part of Ser. No. 192,801, Feb. 14, 1994, Pat. No. 5,624,211, and a continuation-in-part of Ser. No. 382,985, Feb. 3, 1995, Pat. No. 5,586,841, and a continuation-in-part of Ser. No. 468,633, Jun. 6, 1995, Pat. No. 5,577,866, and a continuation-in-part of Ser. No. 466, 806, Jun. 7, 1995, Pat. No. 5,494,379.

[51] Int. Cl.[6] ..... E02D 29/02

[52] U.S. Cl. ..... 405/262; 405/286; 405/284

[58] Field of Search ..... 405/262, 284, 405/286

[56] References Cited

U.S. PATENT DOCUMENTS

| | | | |
|---|---|---|---|
| 1,762,343 | 6/1930 | Munster . | |
| 4,116,010 | 9/1978 | Vidal | 405/262 |
| 4,324,508 | 4/1982 | Hilfiker . | |
| 4,341,491 | 7/1982 | Neumann | 405/262 X |
| 4,343,572 | 8/1982 | Hilfiker | 405/284 |
| 4,514,113 | 4/1985 | Neumann | 405/286 |
| 4,710,062 | 12/1987 | Vidal et al. | 405/262 |
| 4,725,170 | 2/1988 | Davis | 405/284 X |
| 4,961,673 | 10/1990 | Pagano et al. | 405/284 X |
| 5,190,413 | 3/1993 | Carey | 405/262 X |
| 5,207,038 | 5/1993 | Negri | 405/262 X |
| 5,451,120 | 9/1995 | Martinez-Gonzalez | 405/262 |
| 5,474,405 | 12/1995 | Anderson et al. | 405/262 X |
| 5,487,623 | 1/1996 | Anderson et al. | 405/262 X |
| 5,507,599 | 4/1996 | Anderson et al. | 405/262 X |

FOREIGN PATENT DOCUMENTS

| | | | |
|---|---|---|---|
| 002216 | 6/1979 | European Pat. Off. . | |
| 351229 | 1/1990 | European Pat. Off. . | |
| 427221 | 5/1991 | European Pat. Off. . | |
| 3144014 | 6/1991 | Japan | 405/262 |

*Primary Examiner*—Tamara L. Graysay
*Assistant Examiner*—Frederick L. Lagman
*Attorney, Agent, or Firm*—Banner & Witcoff, Ltd

[57] ABSTRACT

A modular block wall includes dry cast, unreinforced modular wall blocks with anchor type, or frictional type or composite type soil stabilizing elements recessed therein and attached thereto by vertical rods which also connect the blocks together. The soil stabilizing elements are positioned in counterbores or slots in the blocks and project into the compacted soil behind the courses of modular wall blocks. Alternative stabilizing element designs may be used with the modular wall blocks and other types of facing elements in a mechanically stabilized earth structure.

11 Claims, 25 Drawing Sheets

46
47

46

50
C
W
53
62
66
56
70
52
U
68
74
72
64
54

70
58
62
74
60
72
64

H
58
74
70
60
62

H
W
X
Y
Z
80
82
84
86
88
90
92
94
96
98
100
102
103
104

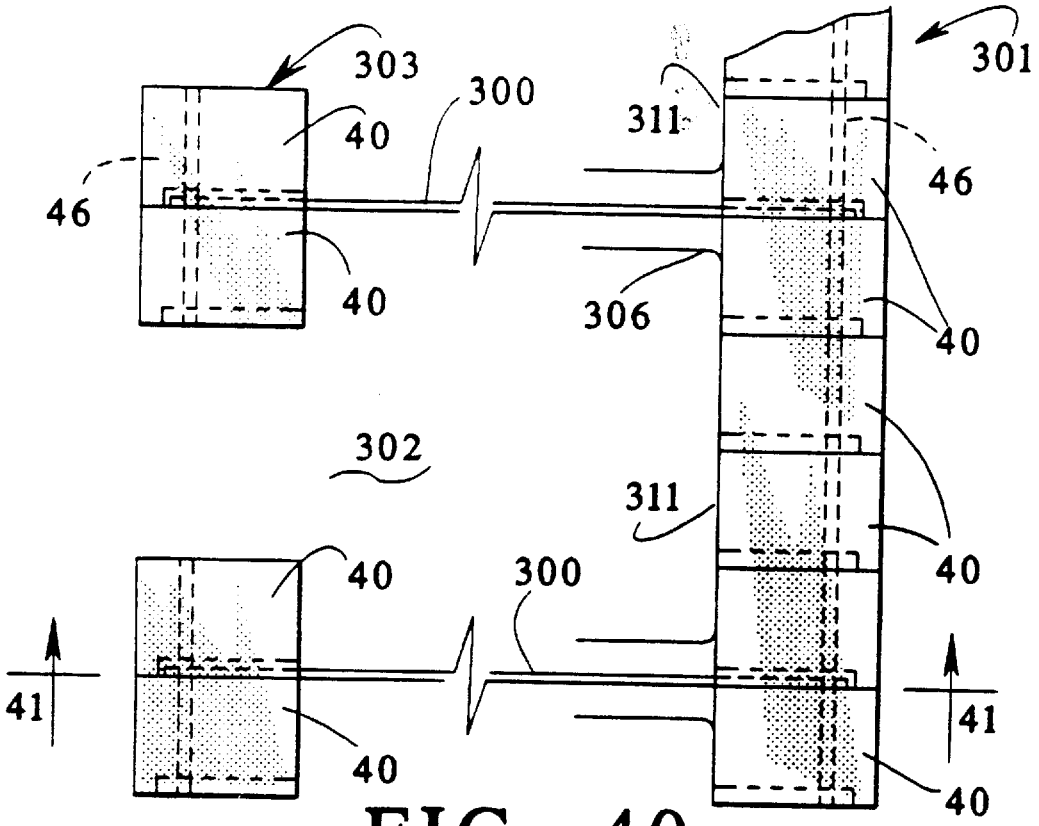
FIG. 40
FIG. 13A
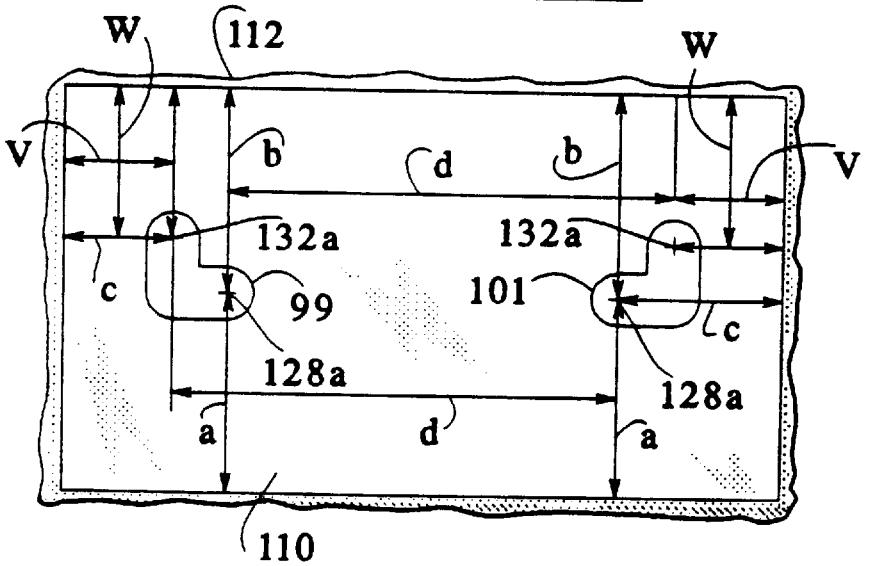

400
410
428
430
422
412
420

486
484
482
480

400
480
420
422

STABILIZING ELEMENTS FOR MECHANICALLY STABILIZED EARTHEN STRUCTURE

CROSS REFERENCE TO RELATED APPLICATION

This is a continuation-in-part application to the following U.S. Patent Applications which are incorporated herewith by reference:

| Ser. No. | Filing Date | Title |
|---|---|---|
| 08/040,904 | March 31, 1993, now U.S. Pat. No. 5,507,599 | Modular Block Retaining Wall Construction and Components |
| 08/108,933 | August 18, 1993, now U.S. Pat. No. 5,487,623 | Modular Block Retaining Wall Construction and Components |
| 08/468,633 | June 6, 1995, now U.S. Pat. No. 5,577,866 | Earthen Work With Wire Mesh Facing (attorney docket no. 93,832-H, which is a continuation of Ser. No. 08/114,098, filed August 30, 1993). |
| 08/137,585 | October 15, 1993, now U.S. Pat. No. 5,474,405 | Low Elevation Wall Construction |
| 08/466,806 | June 7, 1995, now U.S. Pat. No. 5,494,379 | Earthen Work With Wire Mesh Facing (attorney docket no. 93,832-F, which is a continuation-in-part of attorney docket no. 93,832-G, filed June 6, 1995, which is a continuation of Ser. No. 08/156,053, filed November 22, 1993). |
| 08/192,801 | February 14, 1994, now U.S. Pat. No. 5,624,211 | Modular Block Retaining Wall Construction and Components |
| 08/382,985 | February 3, 1995, now U.S. Pat. No. 5,586,841 | Dual Purpose Modular Block For Construction of Retaining Walls |

All of for which priority is claimed.

BACKGROUND OF THE INVENTION

This invention relates to an improved retaining wall construction and, more particularly, to a retaining wall construction comprised of modular blocks, in combination with tie-back and/or mechanically stabilized earth elements and compacted particulate or soil. This invention further relates to the stabilizing elements for mechanically stabilized earthen structures and the combination thereof with various facing elements.

In U.S. Pat. No. 3,686,873 and U.S. Pat. No. 3,421,326, Henri Vidal discloses a constructional work now often referred to as a mechanically stabilized earth or earthen structure. The referenced patents also disclose methods for construction of mechanically stabilized earth structures such as retaining walls, embankment walls, platforms, foundations, etc. In a typical mechanically stabilized earth construction, particulate earthen material interacts with longitudinal elements such as elongated steel strips positioned at appropriately spaced intervals in the earthen material. The elongate elements are generally arrayed for attachment to reinforced precast concrete wall panels and, the combination forms a cohesive embankment and wall construction. The longitudinal or elongate elements, which extend into the earthen work, interact with compacted soil particles principally by frictional interaction and thus mechanically stabilize the earthen work. They are often termed stabilizing elements. The elongate, longitudinal or stabilizing elements may also perform a tie-back or anchor function.

Various embodiments of the Vidal development have been commercially available under various trademarks including the trademarks, REINFORCED EARTH embankments and RETAINED EARTH embankments. Moreover, other constructional works of this general nature have been developed. By way of example and not by way of limitation, Hilfiker in U. S. Pat. No. 4,324,508 discloses a retaining wall comprised of elongated panel members with wire grid mats attached to the backside of the panel members projecting into an earthen mass.

Vidal, Hilfiker and others generally disclose large precast, reinforced concrete wall panel members cooperative with strips, mats, etc. to provide a mechanically stabilized earth construction. Vidal, Hilfiker and others also disclose or use various shapes of precast concrete wall panel members. It is also noted that in constructions disclosed by Vidal and Hilfiker, the elements interactive with the compacted earth or particulate behind the wall panels or blocks, are typically rigid steel strips or mats which rely upon friction and/or anchoring interaction with the particulate, although ultimately, all interaction between such elements and the earth or particulate is dependent upon friction. Wire mats or mesh are also disclosed as vertical facing elements in place of the concrete panel members.

In such circumstances, smaller precast blocks rather than large precast panels may be used to define the wall. Forsberg in U.S. Pat. No. 4,914,876 discloses the use of smaller retaining wall blocks in combination with flexible plastic netting as a mechanically stabilizing earth element to thereby provide a mechanically stabilized earth retaining wall construction. Using flexible plastic netting and smaller, specially constructed blocks arranged in rows superimposed one upon the other, reduces the necessity for large or heavy mechanical lifting equipment during the construction phase of such a wall.

Others have also suggested the utilization of facing blocks of various configurations with concrete anchoring and/or frictional netting material to build an embankment and wall. Among the various products of this type commercially available is a product offered by Rockwood Retaining Walls, Inc. of Rochester, Minn. and a product offered by Westblock Products, Inc. and sold under the trade name, Gravity Stone. Common features of these systems appear to be the utilization of various facing elements in combination with backfill, wherein the backfill is interactive with plastic or fabric reinforcing and/or anchoring means which are attached to the facing elements. Thus, there is a great diversity of such combinations available in the marketplace or disclosed in various patents and other references.

Nonetheless, there has remained the need to provide an improved system utilizing anchoring and/or frictional interaction of backfill and elements positioned in the backfill wherein the elements are cooperative with and attachable to facing elements, including blocks which are smaller and lighter than large facing panels such as utilized in many installations or with wire mesh facing elements. The present invention comprises an improved combination of elements of this general nature and provides enhanced versatility in the erection of retaining walls and embankments, as well as in the maintenance and cost of such structures. The present invention further comprises various stabilizing elements useful in the construction of such civil engineering structures.

SUMMARY OF THE INVENTION

Briefly, the present invention comprises a combination of components to provide an improved civil engineering structure including a retaining wall system or construction. The invention also comprises the components or elements from which the civil engineering structure is fabricated. A feature of the invention is a modular wall block which may be used as a facing component for a retaining wall construction. The modular wall block may be unreinforced and dry cast. The block includes a front face which is generally planar, but may be configured in almost any desired finish and shape. The wall block also includes generally converging side walls, generally parallel top and bottom surfaces, a back wall, vertical throughbores or passages through the block specially positioned to enhance the modular character of the block, and counterbores, associated with the throughbores, having a particular shape and configuration which permit the block to be integrated with and cooperative with various types of anchoring and/or earth stabilizing elements. Special corner block and cap block constructions are also disclosed.

Various earth stabilizing and/or anchor elements are also disclosed for cooperation with the modular wall or face block and other blocks or facing elements. An embodiment of the earth stabilizing and/or anchoring elements includes first and second generally parallel tensile rods which are designed to extend longitudinally from the modular wall block into compacted soil or an earthen work. The ends of the tensile rods are configured to fit within the counterbores defined in the top or bottom surface of the modular wall or facing block. Angled or transverse cross members connect the parallel tensile rods and are arrayed not only to enhance the anchoring characteristics, but also the frictional characteristics of interaction of the tensile rods with earth or particulate material comprising the civil engineering structure. Numerous alternative stabilizing elements are disclosed as well as various systems and components for attachment of the stabilizing elements to facing elements such as wall blocks, panels, and the like.

An alternative stabilizing element cooperative with the modular blocks comprises a harness which includes generally parallel tension arms that fit into the counterbores in the blocks and which cooperate with the vertical anchoring rods so as to attach the tension arms to the blocks. The harness includes a cross member connecting the opposite tension arms adjacent the back face outside of the modular block. The cross member of the harness may be cooperative with a geotextile strip, for example, which extends into the earthen work behind the modular wall block. Again, the harness cooperates with vertical anchoring rods which extend into the passages or throughbores defined in the modular blocks.

The described wall construction further includes generally vertical anchoring rods that interact both with the stabilizing elements and also with the described modular blocks by extending vertically through the throughbores in those blocks while simultaneously engaging the stabilizing elements. Various other alternative permutations, combinations and constructions of the described components are set forth.

Thus it is an object of the invention to provide an improved retaining wall construction comprised of modular blocks and cooperative stabilizing elements that project into an earthen work or particulate material.

It is a further object of the invention to provide an improved and unique modular block construction for utilization in the construction of a improved retaining wall construction.

Yet another object of the invention is to provide a modular block construction which may be easily fabricated utilizing known casting or molding techniques.

Yet a further object of the invention is to provide a substantially universal modular wall block which is useful in combination with earth retaining or stabilizing elements as well as anchoring elements.

Yet another object of the invention is to provide numerous unique earth anchoring and/or stabilizing elements that are cooperative with a modular wall or facing block or other facing elements.

Another object of the invention is to provide various stabilizing element designs and also various useful designs for components to attach stabilizing elements to facing elements.

Yet a further object of the invention is to provide a combination of components for manufacture of a retaining wall system or construction which is inexpensive, efficient, easy to use and which may be used in designs susceptible to conventional design or engineering techniques.

Another object of the invention is to provide a design for a modular block which may be used in a mechanically stabilized earth construction or an anchor wall construction wherein the block may be unreinforced and/or manufactured by dry cast or pre-cast methods, and/or interactive with rigid, metal stabilizing elements as well as flexible stabilizing elements such as geotextiles.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 13A is a top plan view of an alternate throughbore pattern for a corner block;

FIG. 40 is a side elevation of an alternative wall construction utilizing anchor type stabilizing elements;

FIG. 54 is a side elevation of another stabilizing element construction in combination with a system for fastening the stabilizing element to a panel, a block or the like;

DESCRIPTION OF THE PREFERRED EMBODIMENTS

General Description

Figure 1:
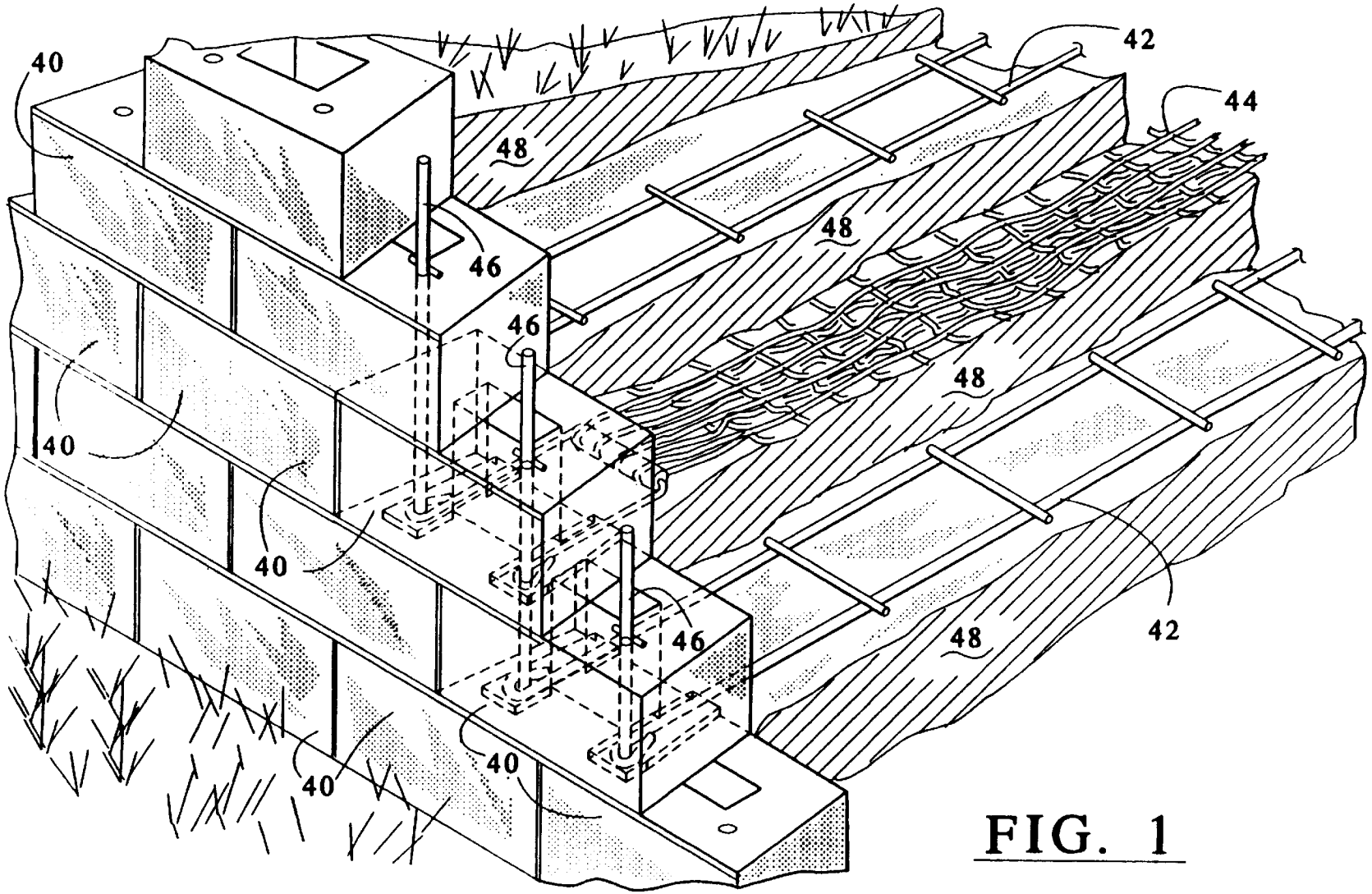
FIG. 1 is an isometric, cut away view of an embodiment and example of the modular block retaining wall construction of the invention incorporating various alternative elements or components.
Figure 3:
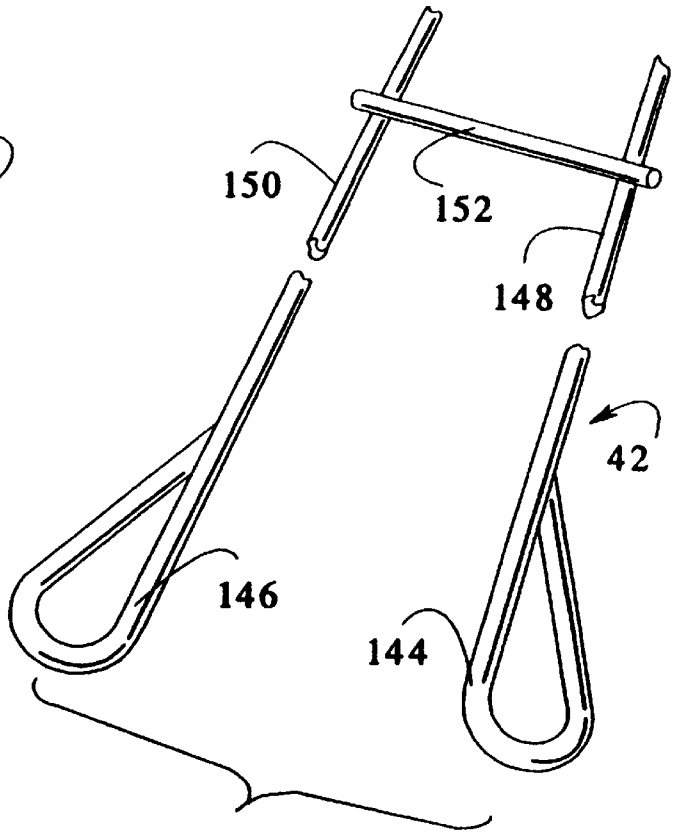
FIG. 3 is an isometric view of an earthen stabilizing and/or anchor element which is used in combination with the modular block of FIG. 2 and which cooperates with and interacts with earth or particulate by means of friction and/or anchoring means or both.

FIG. 1 generally depicts the combination of components or elements which define the modular block retaining wall construction of the invention. Modular blocks 40 are arranged in courses one upon the other in an overlapping array. Generally rigid earth retaining or stabilizing elements 42 and/or flexible stabilizing elements 44 are cooperative with or interact with the blocks 40. Also, anchoring elements such as tie back elements may be utilized in cooperation with blocks 40. The stabilizing or anchoring elements 42, 44 are attached to blocks 40 by means of vertical anchoring rods 46. The elements 42 and/or 44 project from the back face of blocks 40 into compacted soil 48 and interact with the soil 48 as anchors and/or frictionally.

It is noted that interaction between the elements 42 and 44 and soil or particulate 48 depends ultimately upon frictional interaction of particulate material comprising the soil 48 with itself and with elements, such as elements 42 and 44. Conventionally, that interaction may be viewed as an anchoring interaction in many instances rather than a frictional interaction. Thus, for purposes of the disclosure of the present invention, both frictional and anchoring types of interaction of compacted soil 48 with stabilizing and/or anchor elements are considered to be generally within the scope of the invention.

The invention comprises a combination of the described components including the blocks 40, stabilizing elements 42 and/or 44, anchoring rods 46 and soil 48 as well as the separate described components themselves, the method of assembly thereof, the method of manufacture of the separate components and various ancillary or alternative elements and their combination. Following is a description of these various components, combinations and methods.

Facing Block Construction

Figure 2:
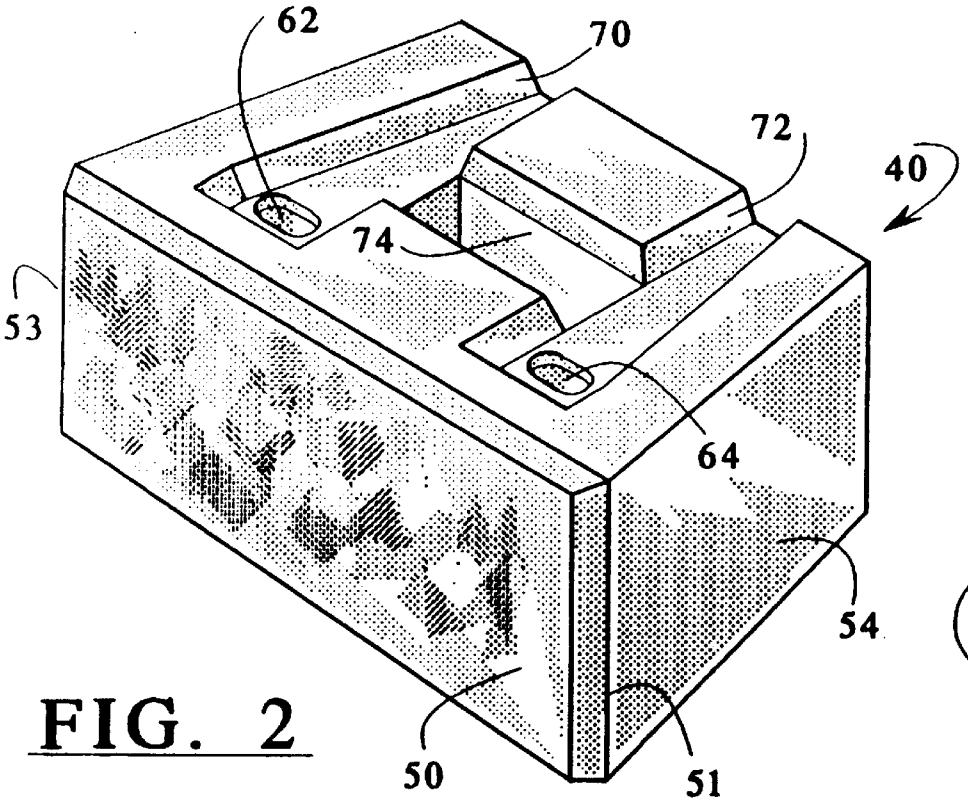
FIG. 2 is an isometric view of the improved standard modular wall block utilized in the retaining wall construction of the invention.
Figures 4, 4A, 5, 6, 7:
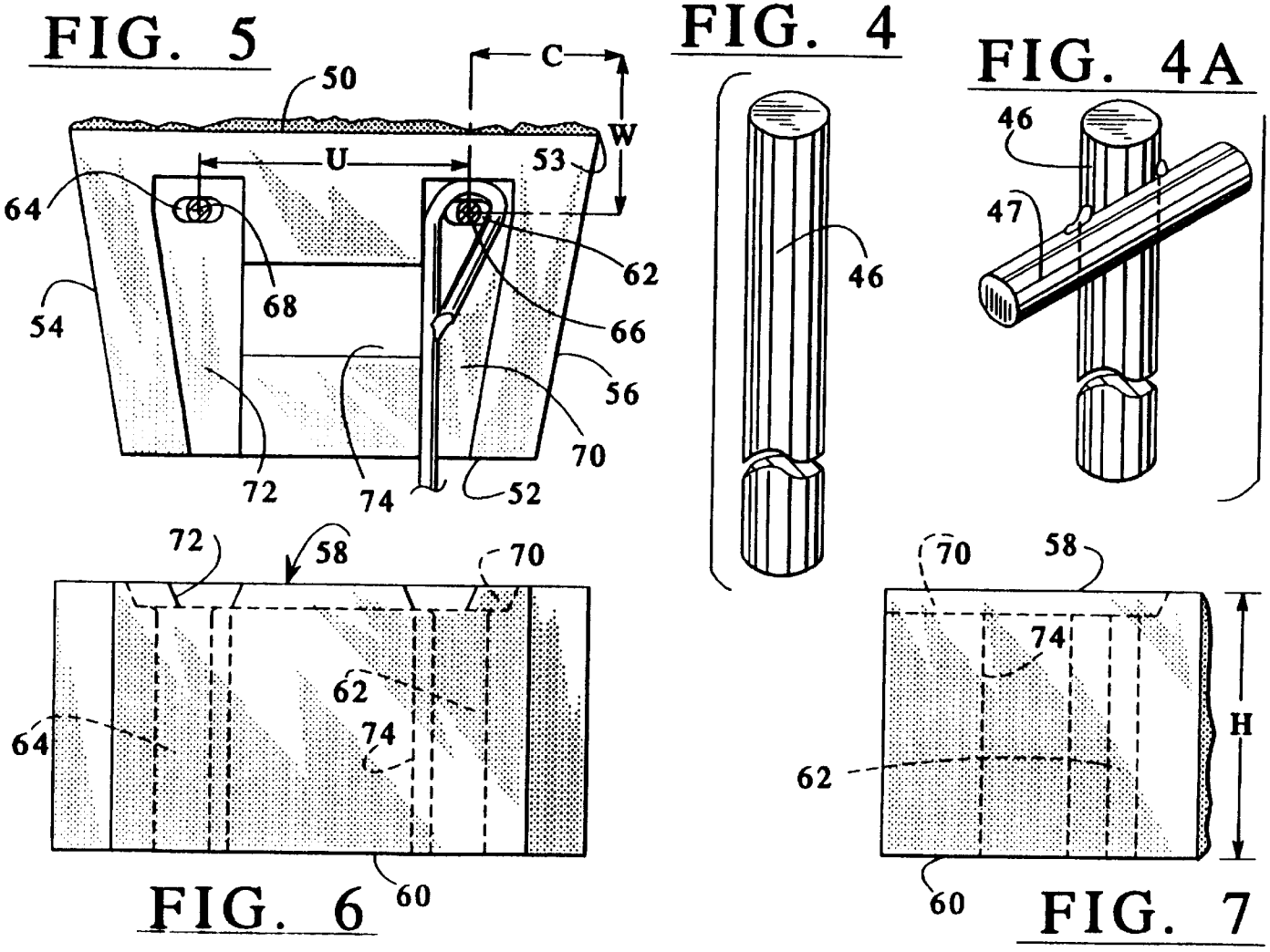
FIG. 4 is an isometric view of a typical anchoring rod which interacts with the wall block of FIG. 2 and the earth stabilizing element of FIG. 3 in the construction of the improved retaining wall of the invention.
FIG. 4A is an alternate construction of the rod of FIG. 4.
FIG. 5 is a bottom plan view of the block of FIG. 2.
FIG. 6 is a rear elevation of the block of FIG. 5.
FIG. 7 is a side elevation of the block of FIG. 5.
Figure 31:
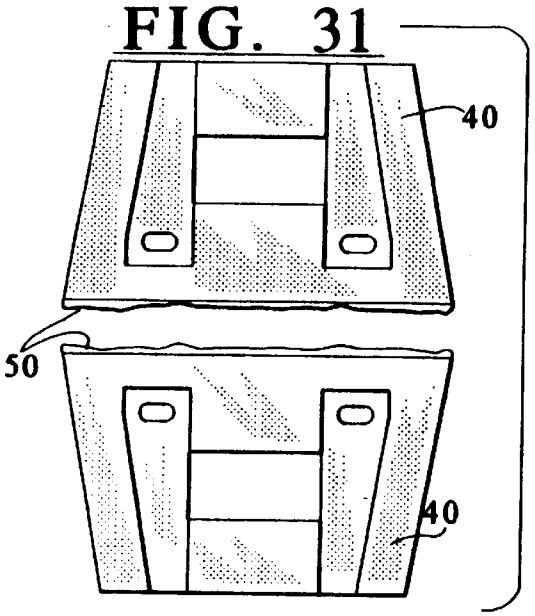
FIG. 31 is a bottom plan view similar to FIG. 30 depicting the manner in which the cast blocks of FIG. 30 are separated to provide a pair of separate modular facing blocks.
Figure 30:
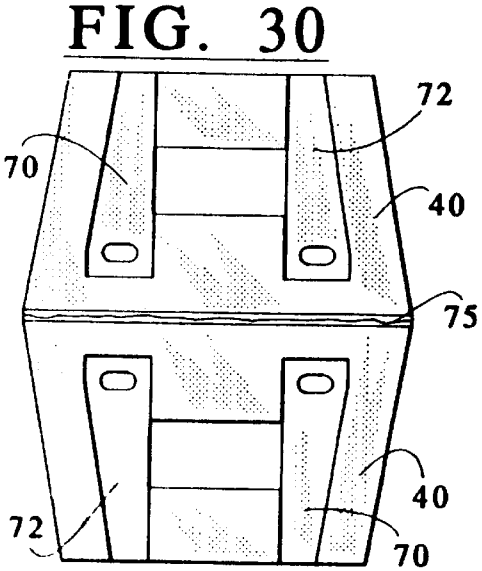
FIG. 30 is a bottom plan view of the modular facing block of the invention as it is initially dry cast in a mold for a pair of facing blocks.

FIG. 2, as well as FIGS. 5 through 13, 13A, 30 through 36A, 44 and 45 illustrate in greater detail the construction of standard modular or facing blocks 40 and various other blocks. FIG. 2, as well as FIGS. 5 through 7, depict the basic modular block 40 which is associated with the invention. FIGS. 30 and 31 are also associated with the basic or standard modular block 40 in FIG. 2. The remaining figures relate to other block constructions.

Standard Modular Block

As depicted in FIGS. 2 and 5 through 7, the standard modular block 40 includes a generally planar front face 50. The front face 50, in its preferred embodiment, is typically aesthetically textured as a result of the manufacturing process. Texturing is, however, not a limiting characteristic of the front face 50. The front face 50 may include a precast pattern. It may be convex or concave or some other desired cast or molded shape. Because the block 40 is manufactured principally by casting techniques, the variety of shapes and configurations, surface textures and the like for the front face 50 is not generally a limiting feature of the invention.

The front face 50, however, does define the outline of the modular blocks comprising the wall as shown in FIG. 1. Thus, the front face 50 defines a generally rectangular front elevation configuration, and because the blocks 40 are typically manufactured by means of casting techniques, the dimensions of the perimeter of front face 50 are typically those associated with a standard concrete block construction. The size or dimension, however, is not a limiting feature of the invention.

Spaced from and generally parallel to the front face 50 is a back face 52. The back face 52 is connected to the front face 50 by means of side walls 54 and 56 which generally converge towards one another from the front face 50. The convergence is generally uniform and equal on both sides of the block 40. Convergence may commence from front edges 51, 53, or may commence a distance from front face 50 toward back face 52. Convergence may be defined by a single flat side surface or multiple flat or curved side surfaces. The convergence angle is generally in the range of 7° to 15°, in the preferred embodiment of the invention, though, a range of convergence of 0° to about 30° is useful.

The thickness of the block 40, or in other words the distance between the front face 50 and back face 52, may be varied in accord with engineering and structural considerations. Again, typical dimensions associated with concrete block constructions are often relied upon by casters and those involved in precast or dry cast operations of block 40. Thus, for example, if the dimensions of the front face 50 are 16 inches wide by 8 inches high, the width of the back face would be approximately 12 inches and the depth or distance between the faces 50, 52 would be approximately 8, 10 or 12 inches.

In the embodiment shown, the side walls 54 and 56 are also rectangular as is the back face 52. Parallel top and bottom surfaces 58 and 60 each have a trapezoidal configuration and intersect the faces 50, 52 and walls 54, 56. In the preferred embodiment, the surfaces 58, 60 are congruent and parallel to each other and are also at generally right angles with respect to the front face 50 and back face 52.

The block 40 includes a first vertical passage or throughbore 62 and a second vertical passage or throughbore 64. Throughbores 62, 64 are generally parallel to one another and extend between surfaces 58, 60. As depicted in FIG. 5 the cross-sectional configurations of the throughbores 62 and 64 are preferably uniform along their length. The throughbores 62, 64 each include a centerline axis 66 and 68, respectively. The cross-sectional shape of each of the throughbores 62 and 64 is substantially identical and comprises an elongated or elliptical configuration or shape.

Each of the throughbores 62 and 64 and, more particularly, the axis 66 and 68 thereof, is precisely positioned relative to the side edges 51 and 53 of the front face 50. The side edges 51 and 53 are defined by the intersection respectively of the side wall 54 and front face 50 and side wall 56 and front face 50. The axis 66 is one-quarter of the distance between the side edge 53 and the side edge 51. The axis 68 is one-quarter of the distance between the side edge 51 and the side edge 53. Thus the axes 66 and 68 are arrayed or spaced one from the other by a distance equal to the sum of the distances that the axes 66, 68 are spaced from the side edges 51 and 53.

The throughbores 62 and 64 are positioned intermediate the front face 50 and back face 52 approximately one-quarter of the distance from the front face 50 toward the back face 52, although this distance may be varied depending upon engineering and other structural considerations associated with the block 40. As explained below, compressive forces on the block 40 result when an anchoring rod 46, which fits within each one of the throughbores 62 and 64, engages against a surface of each throughbore 62 or 64 most nearly adjacent the back face 52. The force is generally a compressive force on the material comprising the block 40. Thus, it is necessary, from a structural analysis viewpoint, to ensure that the throughbores 62 and 64 are appropriately positioned to accommodate the compressive forces on block 40 in a manner which will maintain the integrity of the block 40.

A counterbore 70 is provided with the throughbore 62. Similarly, a counterbore 72 is provided with the throughbore 64. Referring first to the counterbore 70, the counterbore 70 is defined in the surface 58 and extends from back face 52 over and around the throughbore 62. Importantly, the counterbore 70 defines a pathway between the throughbore 62 and the back face 52 wherein a tensile member (described below) may be placed in a manner such that the tensile member may remain generally perpendicular to an element, such as rod 46, positioned in the throughbore 62.

In a similar fashion, the counterbore 72 extends from the back face 52 in the surface 58 and around the throughbore 64. In the preferred embodiment, the counterbores 70 and 72 are provided in the top face 58 uniformly for all of the blocks 40. However, it is possible to provide the counterbores in the bottom face 60 or in both faces 58 and 60. Note that since the blocks 40 may be inverted, the faces 58 and 60 may be inverted between a top and bottom position. In sum, the counterbores 70 and 72 are aligned with and constitute counterbores for the throughbores 62 and 64, respectively.

In the preferred embodiment, a rectangular cross-section passage 74 extends parallel to the throughbores 62 and 64 through the block 40 from the top surface 58 to the bottom surface 60. The passage 74 is provided to eliminate weight and bulk of the block 40 without reducing the structural integrity of the block. It also provides a transverse counterbore connecting counterbores 70 and 72. The passage 74 is not necessarily required in the block 40. The particular configuration and orientation, shape and extent of the passage 74 may be varied considerably in order to eliminate bulk and material from the block 40.

The general cross-section of the throughbores 62 and 64 may be varied. Importantly, it is appropriate and preferred that the cross-sectional shape of the throughbores 62 and 64 permits lateral movement of the block 40 relative to anchoring rods 46, for example, which are inserted in the throughbores 62 and 64. Thus, the dimension of the throughbores 62 and 64 in the direction parallel to the back face 52 in the embodiment shown is chosen so as to be greater than the diameter of a rod 46. The transverse (or front to back) dimension of the throughbores 62 and 64 more closely approximates the diameter of the rod 46 so that the blocks 40 will not be movable from front to back into and out of a position. That is, the front face 50 of each of the blocks 40 in separate courses and on top of each other can be maintained in alignment because of the size and configuration of throughbores 62, 64. Consequently, the blocks 40 can be preferably adjusted from side to side as one builds a wall of the type depicted in FIG. 1, though the blocks 40 are not adjustable inwardly or outwardly to any great extent. This maintains the planar integrity of the assembly comprising the retaining wall so that the blocks 40 will be maintained in a desired and generally planar array. Side to side adjustment insures that any gap between the blocks 40 is maintained at a minimum and also permits, as will be explained below, various adjustments such as required for formation of inside and outside curvature of the wall construction.

The depth of the counterbores 70 and 72 is variable. It is preferred that the depth be at least adequate to permit the elements 42 and/or 44 to be maintained below or no higher than the level of surface 58, so that when an additional course of blocks 40 is laid upon a lower course of blocks 40, the elements 42 and/or 44 are appropriately and properly recessed so as not to interfere with an upper course of blocks 40.

Referring briefly to FIGS. 30 and 31, there is illustrated a manner in which the standard modular blocks of FIGS. 2 and 5 can be manufactured. Typically, such blocks may be cast in pairs using dry casting techniques with the front face of the blocks 40 cast in opposition to each other with a split line such as split line 75 as depicted in FIG. 30. Then after the blocks 40 are cast, a wedge or shear may be utilized to split or separate blocks 40 one from the other revealing a textured face such as illustrated in FIG. 31. Appropriate drag and draft angles are incorporated in the molds with respect to such a casting operation as will be understood by those of ordinary skill in the art. Also note, the dry cast blocks 40 are not typically reinforced. However, the dry cast blocks may include reinforcing fibers. Lack of reinforcement and manufacture by dry casting techniques of a block 40 for use with metallic and/or generally rigid stabilizing elements is not known to be depicted or used in the prior art.

Corner and/or Split Face Blocks

Figures 8, 9, 10:
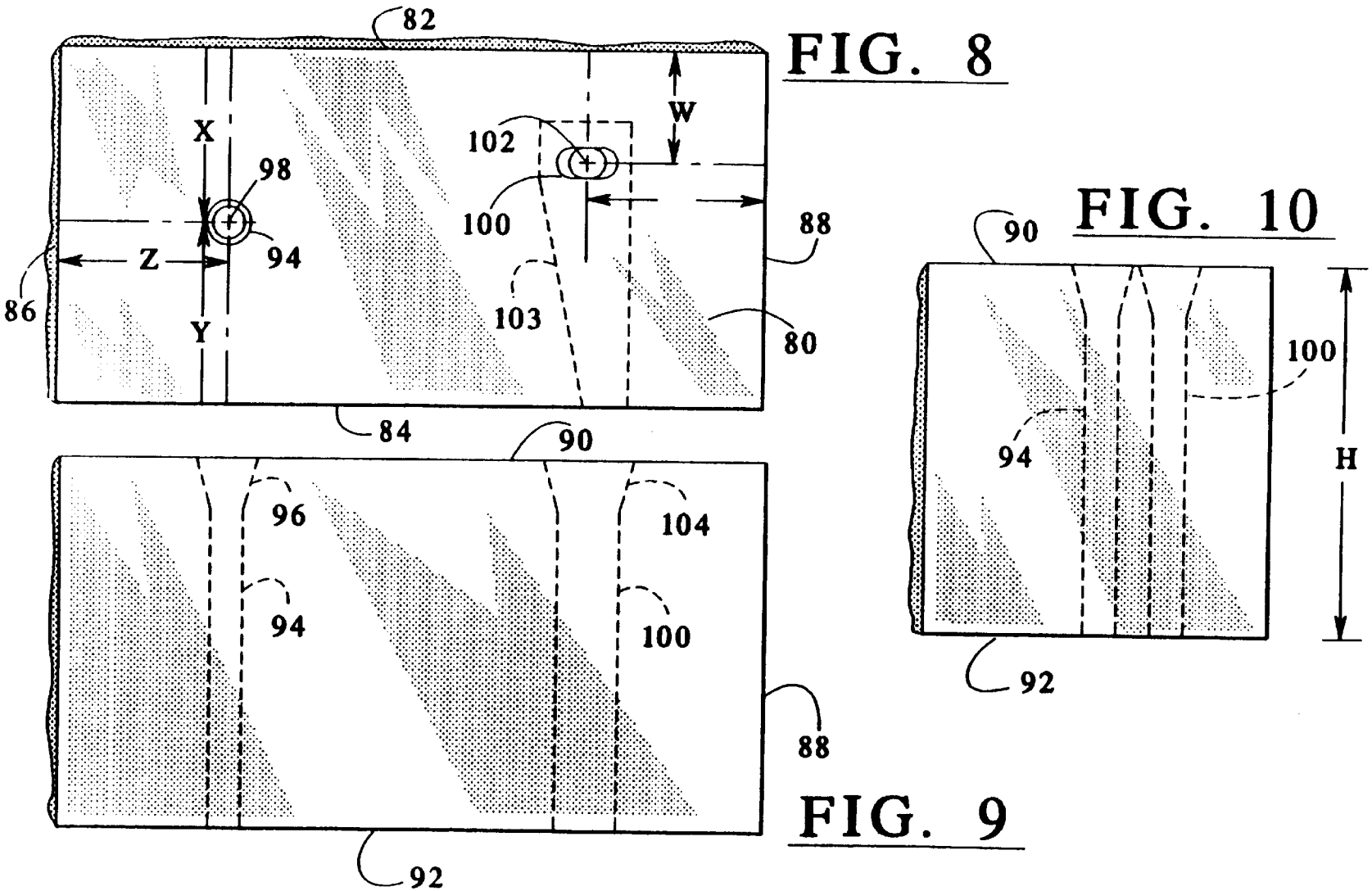
FIG. 8 is a top plan view of a corner block as contrasted with the wall block of FIG. 5.
FIG. 9 is a rear elevation of the block of FIG. 8.
FIG. 10 is a side elevation of the block of FIG. 8.

FIGS. 8 through 13A, and 32 through 36A depict blocks that are used to form corners and/or caps of the improved retaining wall construction of the invention or to define a boundary or split face in such a retaining wall. FIGS. 8, 9 and 10 disclose a first corner block 80 which is similar to, but dimensionally different from the corner blocks of FIGS. 11, 12 and 13 and the corner block 110 of FIG. 13A.

Referring, therefore, to FIGS. 8, 9 and 10, corner block 80 comprises a front face 82, a back face 84, a finished side surface 86 and a unfinished side surface 88. A top surface 90 is parallel to a bottom surface 92. The surfaces and faces generally define a rectangular parallelpiped. The front face 82 and the finished side surface 86 are generally planar and may be finished with a texture, color, composition and configuration which is compatible with or identical to the surface treatment of blocks 40. The corner block 80 includes a first throughbore 94 which extends from the top surface 90 through the bottom surface 92. The throughbore 94 is generally cylindrical in shape; however, the throughbore 94 may include a funnel shaped or frusto-conical section 96 which facilitates cooperation with a rod, such as rod 46, as will be explained below.

The cross-sectional area of the throughbore 94 is slightly larger than the cross-sectional area and configuration of a compatible rod, such as rod 46, which is designed to fit through the throughbore 94. Importantly, the cross-sectional shape of the throughbore 94 and the associated rod, such as rod 46, are generally congruent to preclude any significant alteration and orientation of a positioned corner block 80 once a rod 46 is inserted through a throughbore 94.

The position of the first throughbore 94 relative to the surfaces 82, 84 and 86 is an important factor in the design of the corner block 80. That is, the throughbore 94 includes a centerline axis 98. The axis 98 is substantially an equal distance from each of the surfaces 82, 84 and 86, thus rendering the distances x, y and z in FIG. 8 substantially equal, where x is the distance between the axis 98 and the surface 82, y is the distance between the axis 98 and the surface 84, and z is the distance between the axis 98 and the surface 86.

The corner block 80 further includes a second throughbore 100 which extends from the top surface 90 through the bottom surface 92. The second throughbore 100 may also include a funnel shaped or frusto-conical section 104. The cross-sectional shape of the throughbore 100 generally has an elongated or elliptical form and has a generally central axis 102 which is parallel to the surfaces 82, 84, 86 and 88. The longitudinal dimension of the cross-sectional configuration of the second throughbore 100 is generally parallel to the front face 82. The axis 102 is specially positioned relative to the side surface 88 and the front face 82. Thus the axis 102 is positioned a distance w from the front face 82 which is substantially equal to the distance w which axis 66 is positioned from front face 50 of the block 40 as depicted in FIG. 5. The axis 102 is also positioned a distance v from the unfinished side surface 88 which is substantially equal to the distance c which the axis 62 is positioned from the edge 53 of the front face 50 of the block 40 as depicted again in FIG. 5. A counterbore 103 may be provided for throughbore 100. Counterbore 103 extends from back surface 84 and around bore 100. The counterbore 103 may be provided in both top and bottom surfaces 90 and 92.

The distance u between the axis 102 and the axis 98 for the corner block 80 is depicted in FIG. 8 and is equal to the distance u between the axis 66 and the axis 68 for the block 40 in FIG. 5. The distance u is substantially two times the distance v. The distance v between the axis 102 and the side surface 88 is substantially equal to the distance z between the axis 98 and the side surface 86. The correlation of the various ratios of the distances for the various blocks 40, 80 and 110 set forth above is summarized in the following Table No. 1:

TABLE 1

| | |
|---|---|
| For Block 40 | 2v = u |
| For Corner Block 80 | x = y = z |
| | x + y = u |
| | v + z = u |
| For Corner Block 110 | a = b = c |
| | d = v + c |

Figures 11, 12, 13:
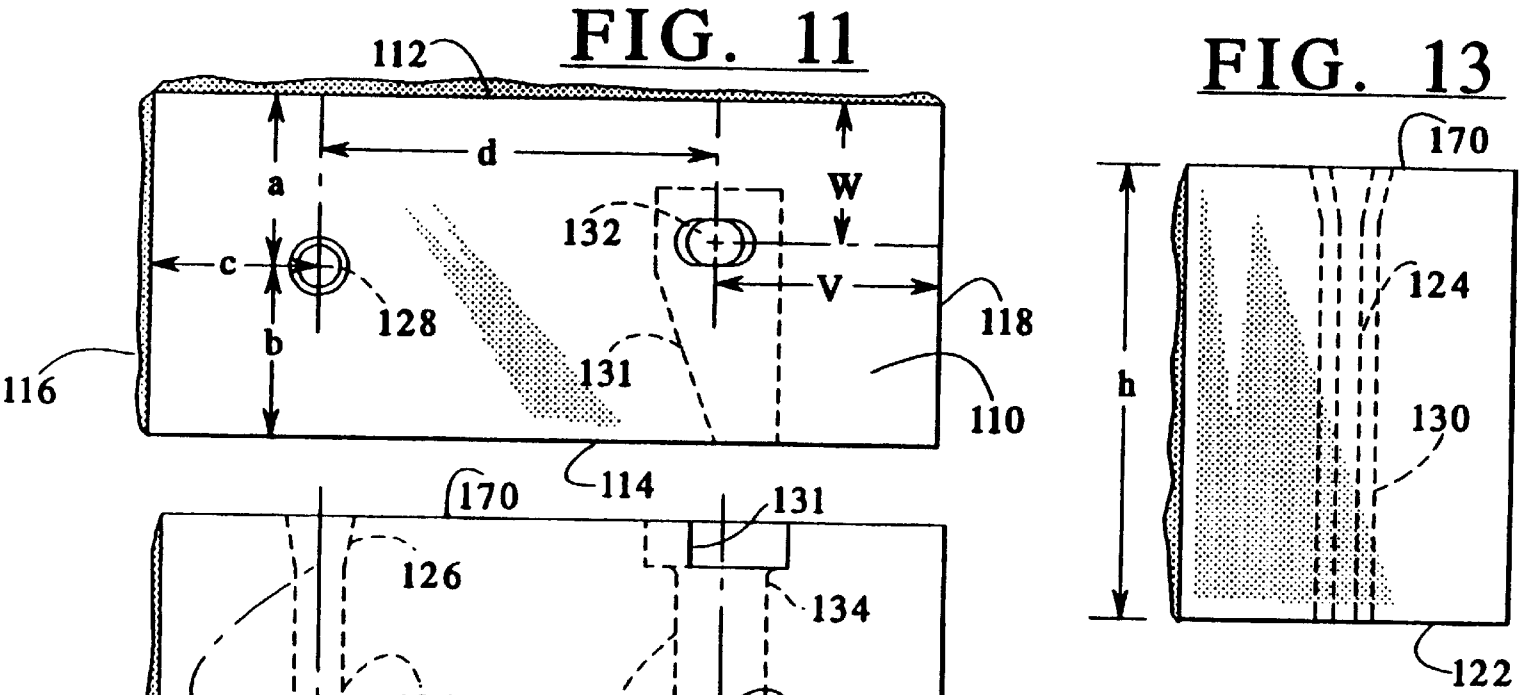
FIG. 11 is a top plan view of an alternative corner block construction.
FIG. 12 is a rear elevation of the block of FIG. 11.
FIG. 13 is a side elevation of the block of FIG. 11.

It is to be noted that the corner block 80 of FIGS. 8, 9 and 10 is a corner block 80 wherein the perimeter of the front face 82 is dimensionally substantially equal to the front face 50 of the block 40. FIGS. 11, 12 and 13 illustrate an alternative corner block construction wherein the front face and finished side face or surface are different dimensionally from that of the corner block 80 in FIGS. 8, 9 and 10.

Referring therefore to FIGS. 11, 12 and 13, a corner block 110 includes a front face 112, a back face 114, a finished side surface 116, an unfinished side surface 118, top and bottom parallel surfaces 120 and 122. The block 110 has a rectangular, parallelpiped configuration like the block 80. The block 110 includes a first throughbore 124, having a shape and configuration substantially identical to that of the first throughbore 94 previously described including the frusto-conical section 126, and an axis 128. Similarly, the block 110 includes a second throughbore 130 having an axis 132 with a cross-sectional configuration substantially identical to that of the second throughbore 100 and also including a frusto-conical or funnel shaped section 134. Also, counterbores 131 may be provided in the top and bottom surfaces 120, 122. The front face 112 and finished side surface 116 are finished, as previously described with respect to front face 50, in any desired fashion. The front face 112 has a height dimension as illustrated in FIG. 13 as height h which is substantially equal to the height h of the block 40 in FIG. 7, as well as the height h of the block 80 as illustrated in FIG. 10.

The axis 128 is again equally spaced from the face 112, surface 116 and surface 114 as illustrated in FIG. 11. Thus, the distance a from the surface 112 to axis 128 equals the distance b from the face 114 to the axis 128 which also equals the distance c from the surface 116 to the axis 128. The axis 132 is spaced from the from face 112 by the distance w which again is equal to the distance w of spacing of axis 66 from face 50 of block 40 as shown in FIG. 5. Similarly, the axis 132 is spaced a distance v from the unfinished side surface 118 which is equal to the distance c associated with the block 40 as depicted in FIG. 5. The distance between the axis 132 and the axis 128 represented by d in FIG. 11 equals the distance v between axis 132 and surface 118 plus distance c, the distance between axis 128 and finished side surface 116. Again, these dimensional relationships are set forth in Table 1.

FIG. 13A illustrates the configuration of a corner block which is reversible and includes throughbores 99, 101 which are shaped with an L shaped cross section so as to function as though they are a combination of throughbores 124, 130 of the embodiment of FIG. 11. Thus, bores 99 and 101 each include an axis 128*a* which is equivalent to axis 128 of the corner block of FIG. 11 and a second axis 132*a* which is equivalent to the axis 132 of the block of FIG. 11.

Other alternative block constructions are possible within the scope of the invention and some modifications and alternatives are discussed below. However, the afore-described block 40 as well as the corner blocks 80 and 110 are principal modular blocks to practice the preferred embodiment of the invention.

Stabilizing Elements

Figure 14:
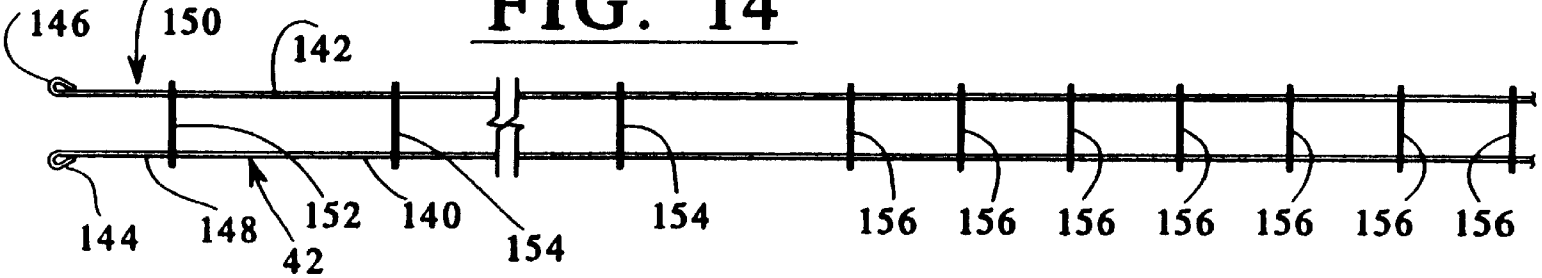
FIG. 14 is a top plan view of a typical earth stabilizing element or component of the type depicted in FIG. 3.

The second major component of the retaining wall construction comprises retaining elements which are interactive with and cooperate with the blocks 40, 80, and 110, particularly the basic block 40. FIGS. 14 through 17 illustrate various stabilizing elements. Referring first to FIG. 14, there is illustrated a stabilizing element 42 which is comprised of a first parallel reinforcing bar 140 and a second parallel reinforcing bar 142. The bars 140 and 142 each have a loop 144 and 146 respectively formed at an inner end thereof Typically, the bars 140 and 142 are deformed to form the loops 144, 146 and the ends of the loops 144, 146 are welded back onto the bar 140 and 142.

Importantly, each loop 144 and 146 is connected to a tension arm 148 and 150 defined by the bars 140 and 142. The tension arms 148 and 150 are parallel to one another and are of such a length so as to extend beyond the back face of any of the blocks previously described. A cross member 152, positioned beyond the back face of the block 40, connects the arms 148 and 150 to ensure their appropriate spacing and alignment. A second cross member 154 ensures that the arms 148 and 150, as well as the bars 140 and 142, remain generally parallel.

There are additional cross members 156 provided along the length of the bars 140 and 142. The spacing of the cross members 156 is preferably generally uniform along the outer ends of the bars 140 and 142. The uniformly spaced cross members 156 are associated with the passive or resistive zone of a mechanically stabilized earth structure as will be described in further detail below. The cross members 156 are thus preferably uniformly spaced one from the other at generally closer intervals in the so called passive or resistive zone. However, this is not a limiting feature and uniform spacing may be preferred by a wall engineer. The bars or cross members 154, as well as cross member 152, are not necessarily closely spaced or even required so long as the bars 140 and 142 are maintained in a substantially parallel array.

It is noted that in the preferred embodiment, that just two bars 140 and 142 are required or are provided. However, stabilizing elements having one or more longitudinal members (e.g. bars 140, 142) may be utilized. The stabilizing element depicted and described with respect to FIG. 14 relies upon frictional interaction but could be configured to rely, as well, upon anchoring interaction with compacted soil. The cross members 156, thus, could be configured to act as a collection of anchors. The bars 140 and 142 and cross members 156 in the preferred embodiment provide frictional interaction with compacted soil.

Figure 15:
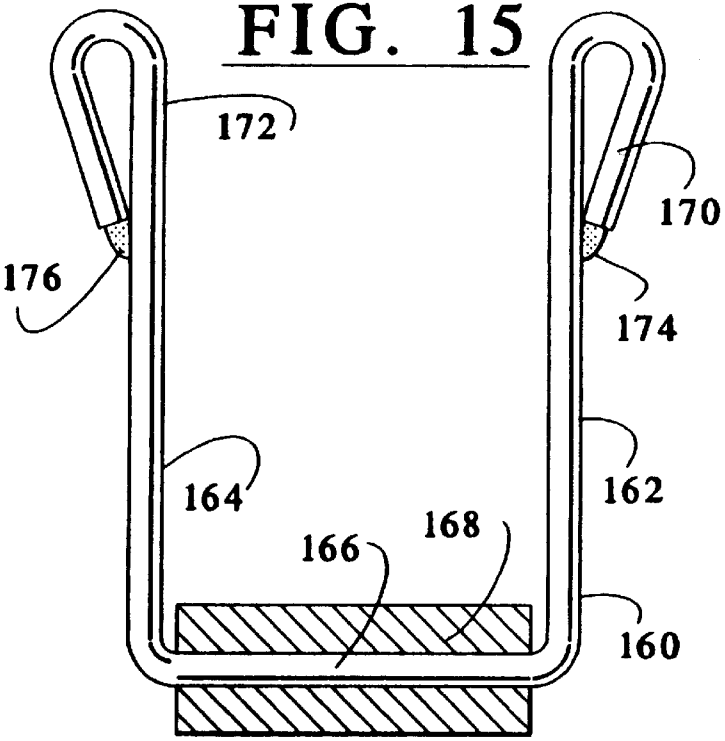
FIG. 15 is a top plan view of a component of an alternative earth stabilizing element.
Figure 15A:
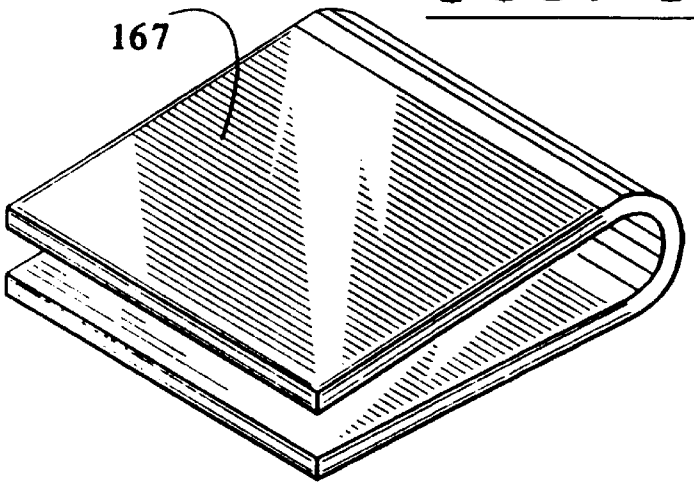
FIG. 15A is an isometric view of an alternative component for the element of FIG. 15.

FIG. 15 illustrates a component of a further alternative stabilizing element 44. Specifically referring to FIG. 15, the element depicted includes a harness or connector 160 which includes a first tension bar or arm 162 and a second bar or arm 164. Arms 162 and 164 are generally parallel to one another and are connected by a cross member 166, which in this case also includes a cylindrical, tubular member 168 retained thereon. Alternatively, as depicted in FIG. 15A, a C-shaped clamp member 167 may be fitted over the cross member 166.

Each of the parallel tension arms 162 and 164 terminate with a loop 170 and 172. The loops 170 and 172 are arranged in opposed relationship and aligned with one another as depicted in FIG. 15. The ends of the loops 170 and 172 are welded at welds 174 and 176, respectively to the arms 162 and 164, respectively.

Figure 17:
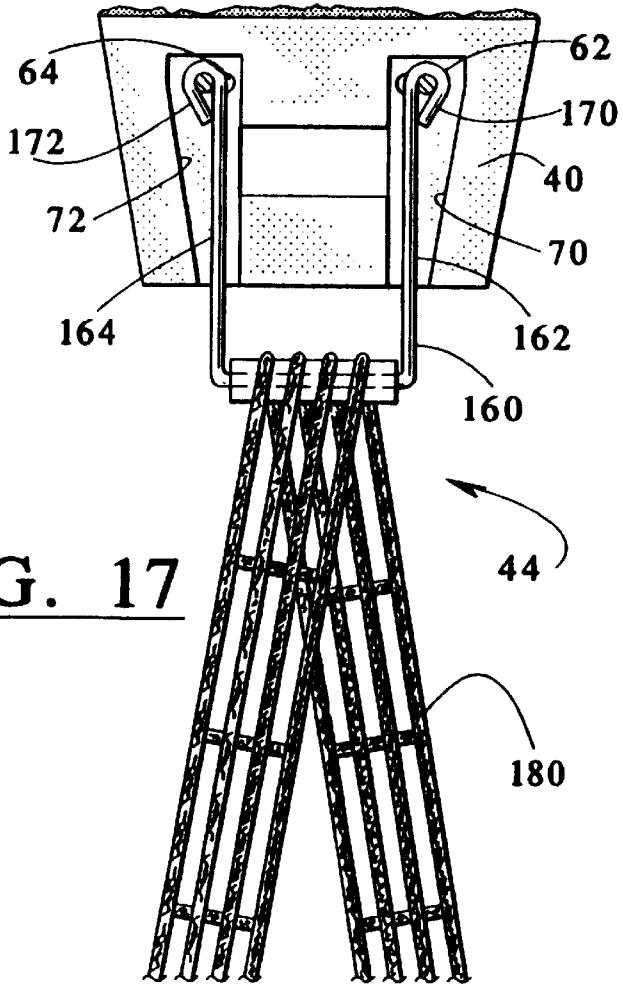
FIG. 17 is a bottom plan view of the component or element depicted in FIG. 16 in combination with a flexible geotextile material and a block of the type shown in FIG. 2.
Figure 16:
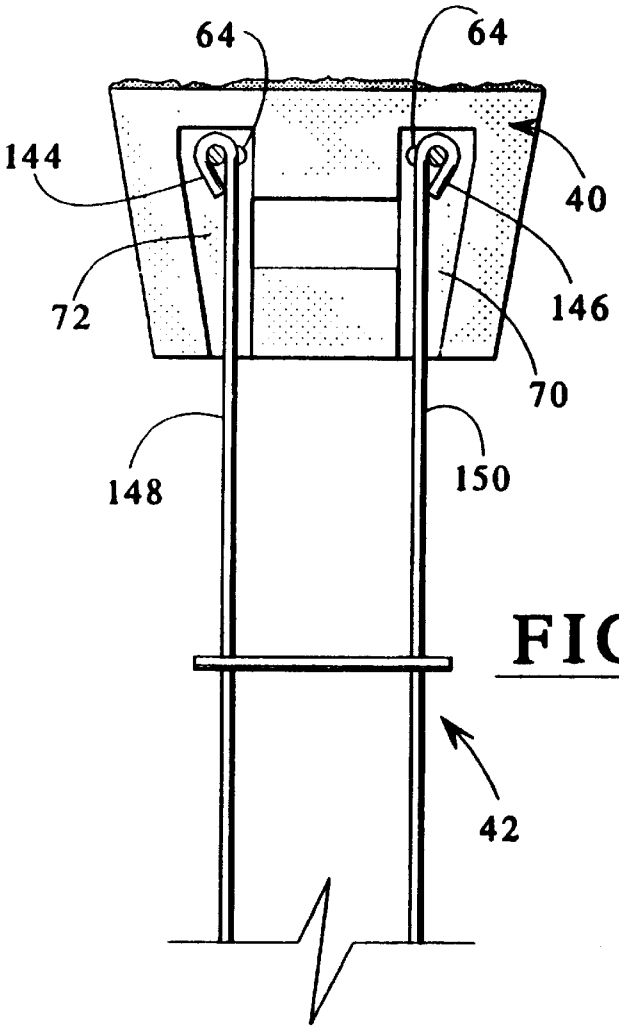
FIG. 16 is a bottom plan view of the element shown in FIG. 14 in combination with a block of the type shown in FIG. 2.

The harness or connector 160 is cooperative with the blocks, most particularly block 40, as will be described in further detail. That detail is illustrated, in part, in FIGS. 16 and 17. Referring first to FIG. 16, there is depicted a stabilizing element 42. FIG. 17 illustrates the stabilizing element 44. Referring to FIG. 16 the element 42 and more particularly the tension arms 148 and 150 are positioned in the counterbores 70 and 72 of block 40 with the loops 144 and 146 positioned over the throughbores 64 and 62, respectively.

Referring to FIG. 17, the connector 160, which comprises a portion of the stabilizing element 44, includes arms 162 and 164 which are fitted into the counterbores 70 and 72, respectively of block 40 with loops 170 and 172, respectively fitted over the throughbores 62 and 64. Note that connector 160 is sufficiently recessed within the block 40 so as to be below the plane of the top surface 58 thereof. Similarly, the tension arms 148 and 150 of the element 42 are sufficiently recessed within the counterbores 70 and 72 to be below the plane or no higher than the plane of the top surface 58 of the block 40.

Referring again to FIG. 17, the element 44 further includes a geotextile material comprising a lattice of polymeric strips, such as strip 180, which is generally flexible and wherein an elongated length thereof is wrapped around or fitted over the tube or cylinder 168 or clamp 167 so that the opposite ends of the strips 180 extend outwardly and away from the block 40. Thus, FIG. 16 illustrates a generally rigid element. FIG. 17 illustrates a generally flexible element. In each event, the elements 42 and 44 are cooperative with a block 40 as described.

Connectors

Depicted in FIG. 4 is a typical connector which comprises a reinforcing rod or bar, normally a steel reinforcing bar 46, which is generally cylindrical in shape and which is fitted through loops, for example loops 170 and 172 in FIG. 17 and associated throughbores 62 and 64 of block 40 to thereby serve to retain the element 44 and more particularly the connector 160 cooperatively engaged with block 40. The rod 46, which is depicted as the preferred embodiment, is cylindrical as previously mentioned. However, any desired size may be utilized. It is to be noted that the steel reinforcing bars, which are recommended in order to practice the invention, are also utilized in cooperation with the specially configured first throughbores 94, 124 of the corner blocks 80, 110. For example first throughbore 124 of the corner block 110 illustrated in FIG. 12 cooperates with a rod such as rod 46 illustrated in FIG. 4. The rods 46 are of a sufficient length so that they will project through at least two adjacent blocks 40 which are stacked one on top of the other thus distributing the compressive forces resulting from the elements 44 interacting with the blocks 40 to blocks of adjacent courses forming a wall.

As depicted in FIG. 4A, the rod 46 may include a small stop or cross bar 47 welded or attached at its midpoint. Cross bar 47 insures that the rod 46 will be positioned properly and retained in position to engage blocks 40 above and below the block 40 in which rod 46 is positioned to cooperate with elements 42, 44. Thus, the rod 46 will not fall or slip downward into throughbores 62, 64.

Retaining Wall System

Figure 18:
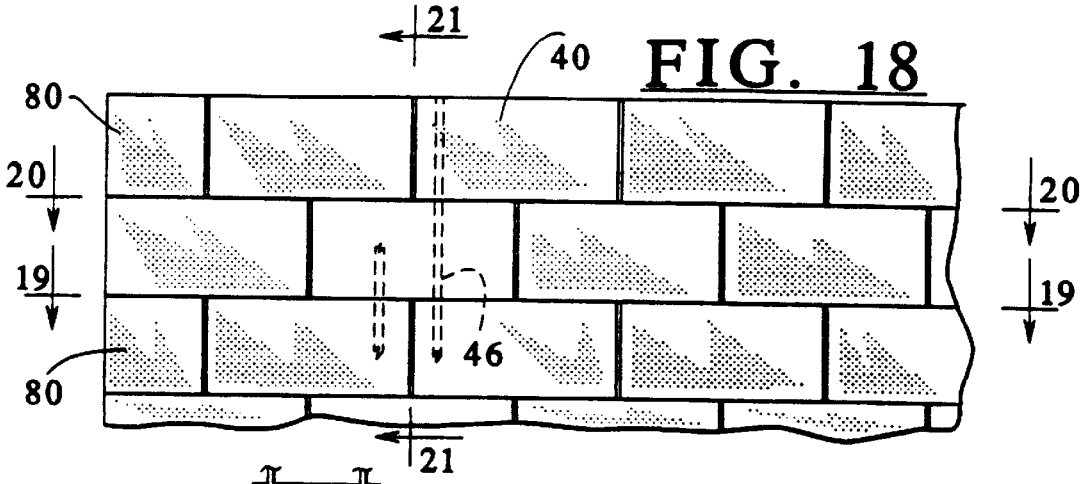
FIG. 18 is a front elevation of a typical assembly of the modular wall blocks of FIG. 2 and corner blocks such as shown in FIG. 8 in combination with the other components and elements forming a retaining wall.

FIGS. 18 through 29 illustrate the manner of assembly of the components heretofore described to provide a retaining wall. Referring first to FIG. 18, there is depicted an array of three courses of modular blocks 40 and corner blocks 80 to define a section or portion of a wall using the components of the invention. Note that each of the courses provide that the blocks 40 are overlapping. Note further that the front face dimensions of the corner block 80 are equal to the front face dimensions of the modular blocks 40. The side face or surface dimensions of the corner blocks 80 are equal to one half of the dimensions of the basic blocks 40.

Figure 19:
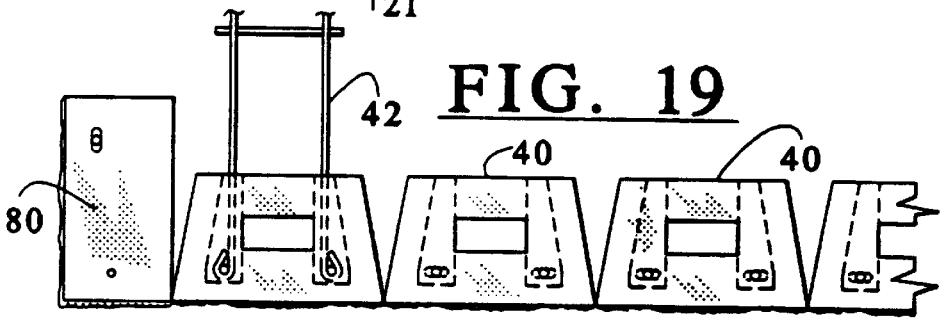
FIG. 19 is a sectional view of the wall of FIG. 18 taken substantially along the line 19—19.

FIG. 19, which is a sectional view of the wall of FIG. 18, illustrates the manner of positioning the corner blocks 80 and modular basic building blocks 40 with respect to each other to define the first course of the wall depicted in FIG. 18. Note that elements 42, which are the rigid stabilizing elements, are cooperatively positioned for interaction with the blocks 40. In the preferred embodiment, stabilizing elements 42 are provided for use in association with each and every one of the modular blocks 40 and the elements 42 include only two parallel reinforcing bars. It is possible to provide for constructions which would have a multiple number of reinforcing bars or special anchoring elements attached to the bars. The preferred embodiment is to use just two bars in order to conserve with respect to cost, and further, the two bar construction provides for efficient distribution of tensile forces and anchoring forces on the element 42, and torsional forces are significantly reduced.

Figure 20:
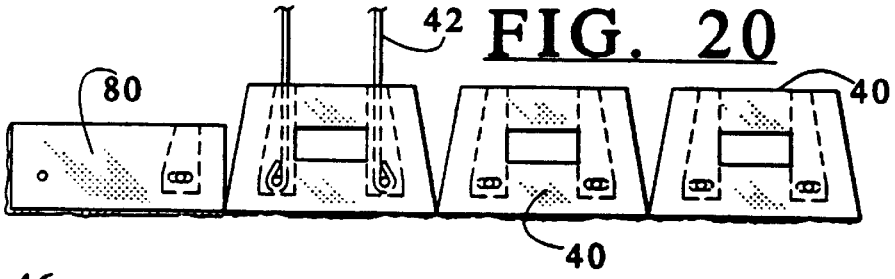
FIG. 20 is a sectional view of the wall of FIG. 18 taken along line 20—20 in FIG. 18.

FIG. 20 illustrates the manner in which the corner block 80 may be positioned in order to define an edge or corner of the wall depicted in FIG. 18. Thus, the block 80, which is a very symmetrical block as previously described, may be alternated between positions shown in FIGS. 19 and 20. Moreover, the corner blocks 80 may be further oriented as depicted and described with respect to FIGS. 27 through 29 below. The element 44, which is a stabilizing element utilizing a flexible polymeric or geotextile material, is depicted as being used with respect to the course or layer of blocks 40 defining or depicted in FIG. 20.

Figure 21:
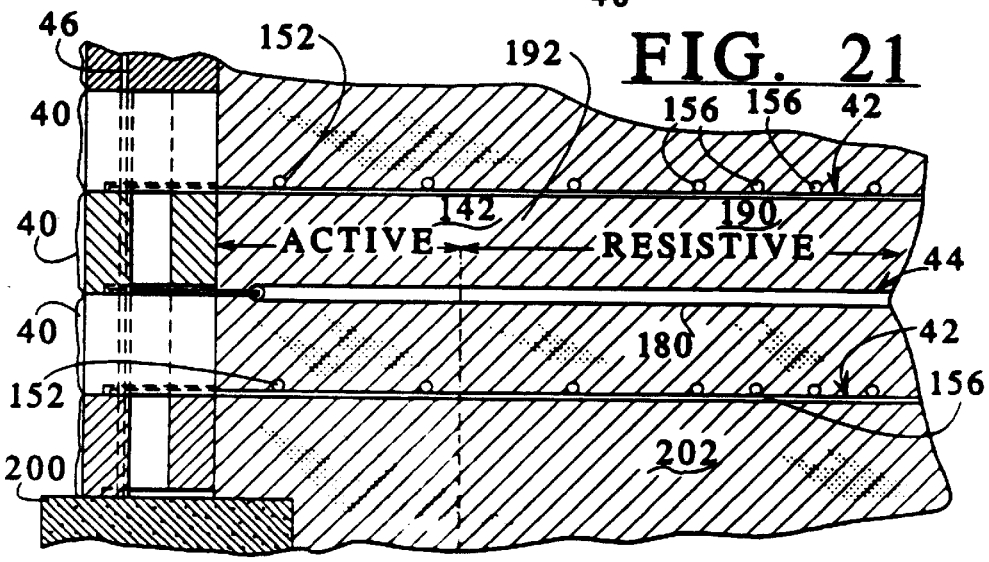
FIG. 21 is a cross sectional view of the wall of FIG. 18 taken substantially along the line 21—21.

FIG. 21 is a side sectional view of the wall construction of FIG. 18. It is to be noted that the wall is designed so that the cross elements 156 are retained in the so-called resistive zone associated with such mechanically stabilized earth structures. As known to those of ordinary skill in the art, construction of such walls and the analysis thereof calls for the defining of a resistive zone 190 and an active zone 192. The elements 42 are designed so that the cross members 156 are preferably more numerous in the resistive zone thus improving the efficiency of the anchoring features associated with the elements 42. However, this is not a limiting feature. FIG. 21 illustrates also the use of the polymeric grid material 180. It is to be noted that all of the elements 42 and/or 44 are retained in a compacted soil or compacted earth in a manner described in the previously referenced prior art patents. Reference is made to the American Association of State Highway and Transportation Officials "Standard Specification for Highway Bridges", Fourteenth Edition as amended (1990, 1991) and incorporated herewith by reference, for an explanation of design calculation procedures applicable for such constructions.

In FIG. 21, there is illustrated the placement of a stabilizing element, such as elements 42 or 44, in association with each and every course of blocks 40, 80. In actual practice, however, the stabilizing elements 42 and/or 44 may be utilized in association with separate layers or courses, e.g. every second, third or fourth course of blocks 40, 80 and/or at separate blocks, eg. every second or third block horizontally in accord with good design principles. This does not, however, preclude utilization of the stabilizing elements 42, 44 in association with each and every course and each and every block 40, 80. Thus, it has been found that the mechanically stabilized earth reinforcement does not necessarily require stabilizing elements at every possible block position. Again, calculations with respect to this can be provided using techniques known to those of ordinary skill in the art such as referenced herein.

During construction, a course of blocks 40 are initially positioned in a line on a desired footing 200, which may consist of granular fill, earthen fill, concrete or other leveling material. Earthen backfill material 202 is then placed behind the blocks 40. An element, such as stabilizing element 42, may then be positioned in the special counterbores 70, 72 in a manner previously described and defined in the blocks 40, 80. Rods 46 may then be inserted to maintain the elements 42 in position with respect to the blocks 40. The rods 46 should, as previously described, interact with at least two adjacent courses of blocks 40. A layer of sealant, fabric or other material (not shown) may be placed on the blocks. Subsequently, a further layer of blocks 40 is positioned onto the rods 46. Additional soil or backfill 202 is placed behind the blocks 40, and the process continues as the wall is erected.

In practice, it has been found preferable to orient the counterbores 70, 72 facing downward rather than upward during construction. This orientation facilitates keeping the counterbores 70, 72 free of debris, etc. during construction.

Figure 23:
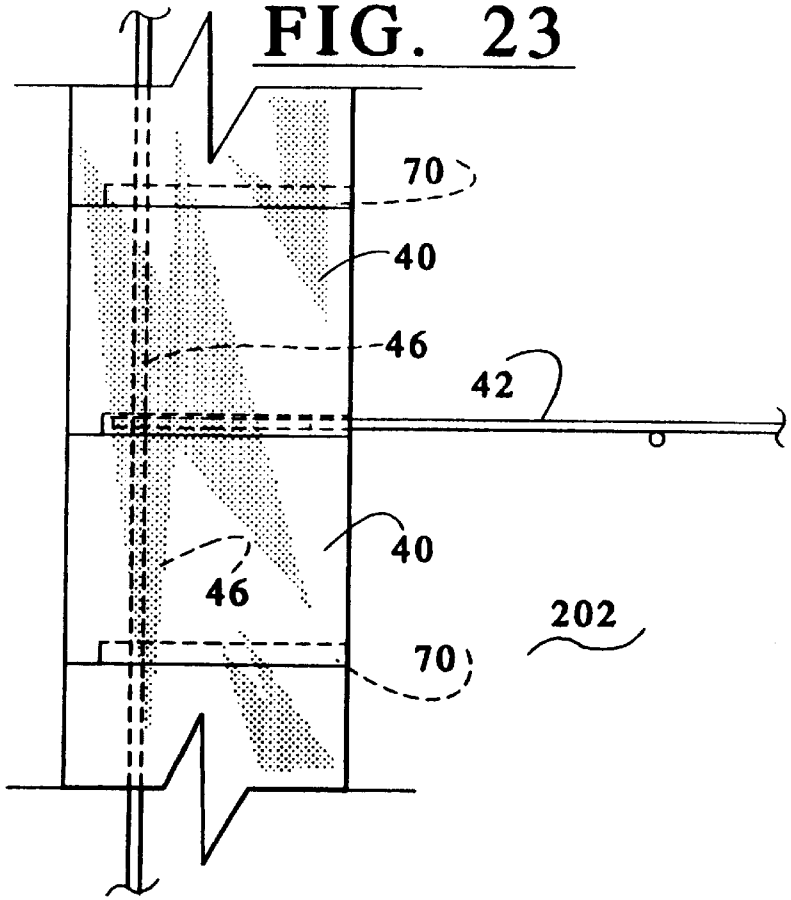
FIG. 23 is a side sectional view of a combination of elements of the type depicted in FIG. 16.
Figure 22:
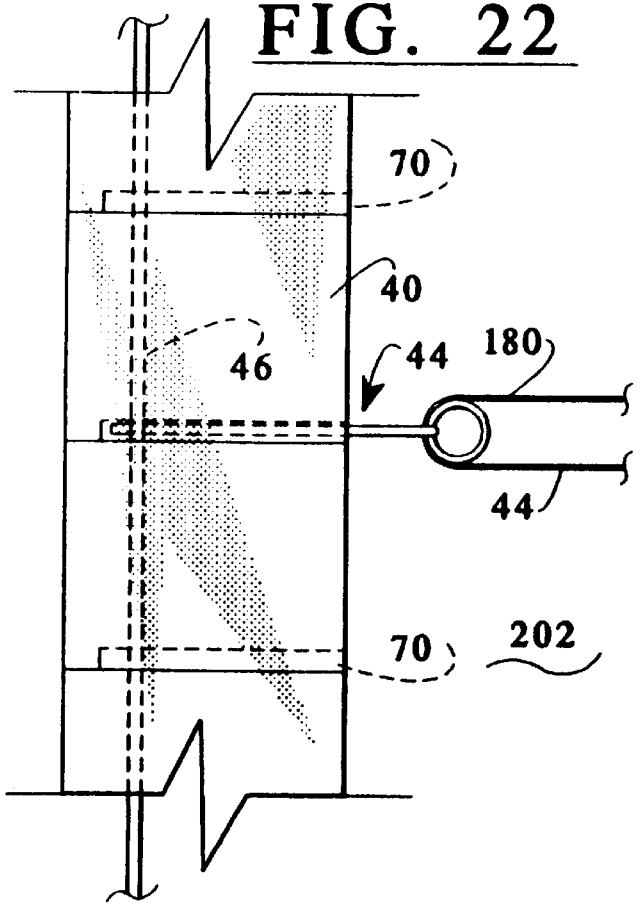
FIG. 22 is a side sectional view of a combination of the type depicted in FIG. 17.

FIGS. 22 and 23 illustrate side elevations of the construction utilizing a flexible stabilizing element 44 in FIG. 22 and a rigid stabilizing element 42 in FIG. 23. In each instance, the elements 42 and/or 44 are cooperative with blocks 40, rods 46 and compacted soil 202 as previously described.

Figure 24:
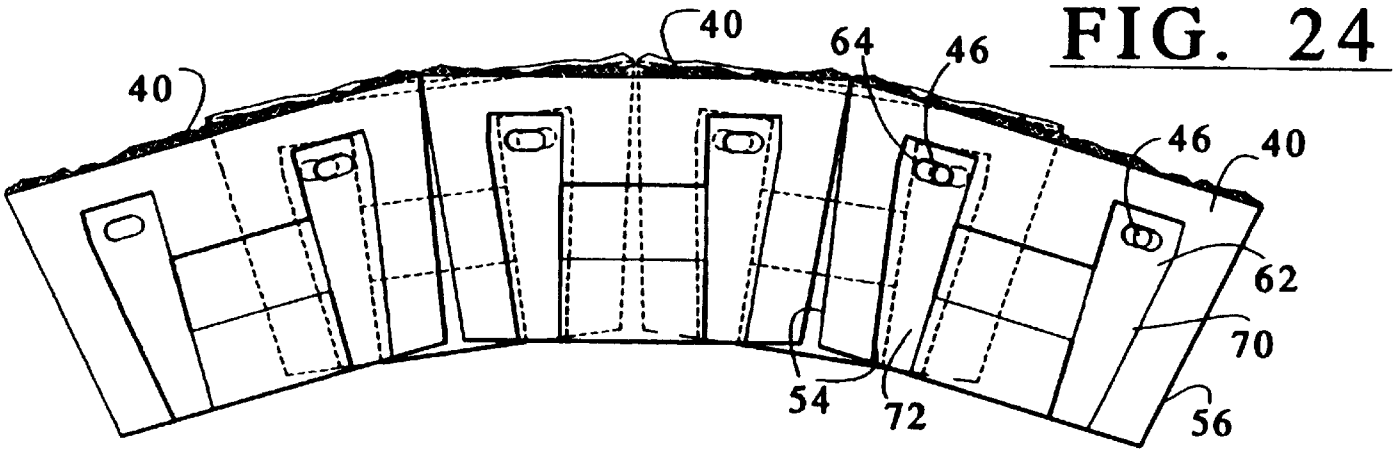
FIG. 24 is a top plan view of a typical retaining wall construction depicting the arrangement of the modular block elements to form an outside curve.
Figure 25:
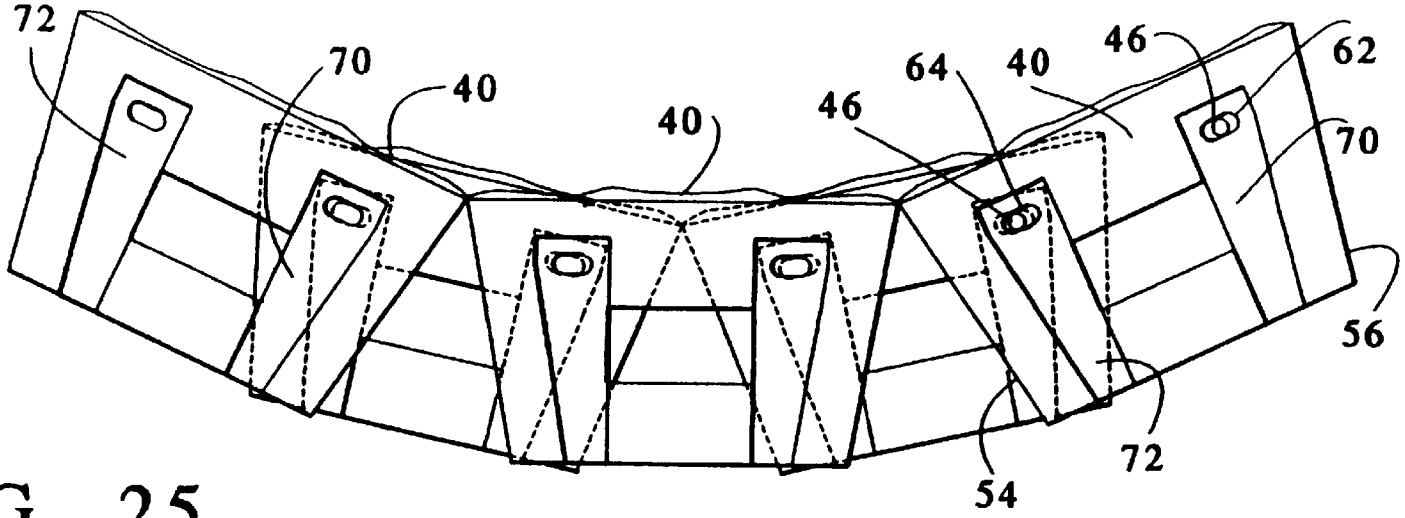
FIG. 25 is a top plan view of modular block elements arranged so as to form an inside curve.

Referring next to FIGS. 24 and 25, as previously noted, the throughbores 62, 64 in the blocks 40 have an elongated cross-sectional configuration. Such elongation permits a slight adjustable movement of the blocks 40 laterally with respect to each other to ensure that any tolerances associated with the manufacture of the blocks 40 are accommodated. It was further noted that the blocks 40 are defined to include converging side surfaces 54, 56. Because the side surfaces 54, 56 are converging, it is possible to form a wall having an outside curve as depicted in FIG. 24 or an inside curve as depicted in FIG. 25. In each instance, the mode of assembly and the cooperative interaction of the stabilizing elements 42, 44 and rods 46 as well as blocks 40 are substantially as previously described with respect to a wall having a flat front surface.

Figure 26:
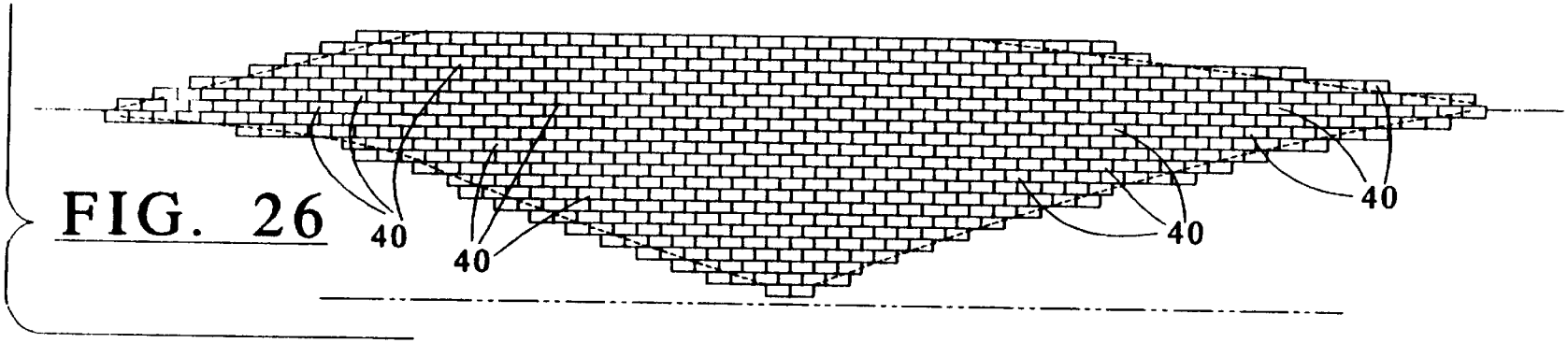
FIG. 26 is a front elevation depicting a typical retaining wall in accord with the invention.

FIG. 26 illustrates the versatility of the construction of the present invention. Walls of various shapes, dimensions and heights may be constructed. It is to be noted that with the combination of the present invention the front face of the wall may be substantially planar and may rise substantially vertically from a footing. Though it is possible to set back the wall or tilt the wall as it ascends, that requirement is not necessary with the retaining wall system of the present invention. Also, the footing may be tiered. Also, the block 40 may be dry cast and is useful in combination with a rigid stabilizing element, such as element 42, as contrasted with geotextile materials.

Figure 28:
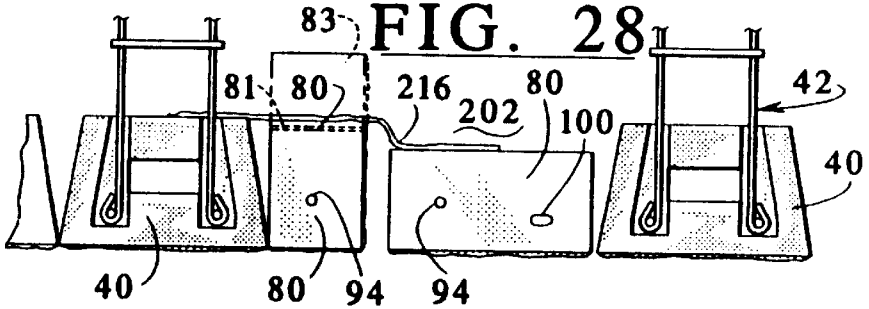
FIG. 28 is a sectional view of the wall shown in FIG. 27 taken substantially along the lines 28—28.
Figure 29:
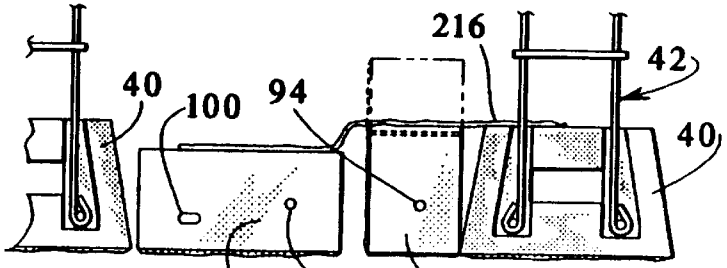
FIG. 29 is a sectional view of the wall of FIG. 27 taken substantially along the line 29—29.
Figure 27:
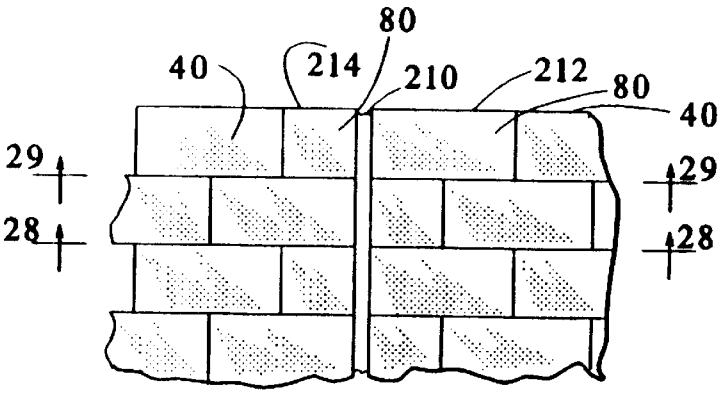
FIG. 27 is an enlarged front elevation of a retaining wall illustrating the manner in which a slip joint may be constructed utilizing the invention.

FIGS. 27, 28 and 29 illustrate the utilization of corner blocks to provide for a slip joint in a conventional wall of the type depicted in FIG. 26. As shown in FIG. 27, a slip joint or vertical slot 210 is defined between wall sections 212 and 214. Sectional views of the walls 212 and 214 are depicted in FIGS. 28 and 29. There it will be seen that the corner blocks 80, which may be turned in either a right handed or left handed direction, may be spaced from one another or positioned as closely adjacent as desired or required. A fabric or other flexible material 216 may be positioned along the back side of the blocks 80 and then backfill 202 positioned against the flexible material 216.

FIG. 29 illustrates the arrangement of these elements including the flexible barrier 216 and the blocks 80 for the next course of materials. It is to be noted that the first throughbore 94 of the corner blocks 80 as well as for the corner block 110 always align vertically over one another as each of the courses are laid. Thus, a rod 46 may be passed directly through the first throughbores 94 to form a rigidly held corner which does not include the capacity for adjustment which is built into the throughbores 62, 64 associated with the blocks 40 or the second throughbore 100 associated with corner blocks 80. The positioning of the throughbores 94 facilitates the described assembly. The blocks 80 may include a molded split line 81 during manufacture. The line 81 facilitates fracture of the block 80 and removal of the inside half 83 as shown in FIG. 28.

Figure 32:
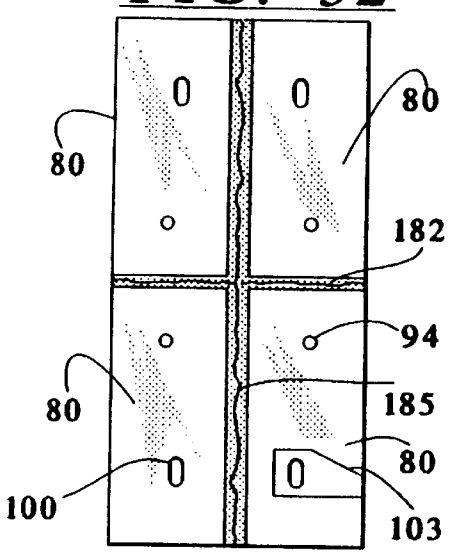
FIG. 32 is a top plan view of the cast formation of the corner blocks.
Figure 33:
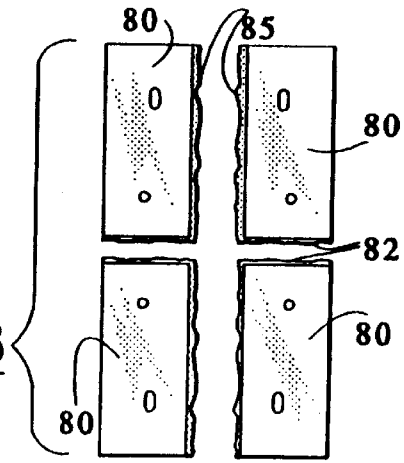
FIG. 33 is a top plan view of the corner blocks of FIG. 32 after they have been split or separated.
Figure 34:
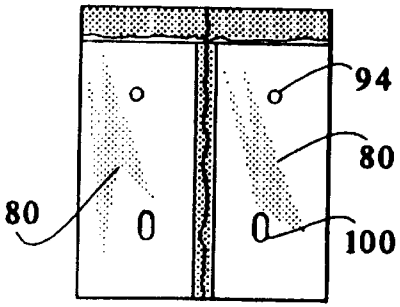
FIG. 34 is a plan view of an alternative casting array for corner blocks.

FIGS. 32, 33 and 34 illustrate a possible method for casting corner blocks 80. Corner blocks 80 may be cast in an assembly comprising four corner blocks wherein the mold provides that the faces 82, 85 of the corner blocks 80 will be in opposition along split lines 182, 185 so that, as depicted in FIG. 32, four corner blocks 80 may be simultaneously cast, or as shown in FIG. 34, two corner blocks 80 may be cast. Then as depicted in FIG. 33, the corner blocks may be split from one another along the molded split lines to provide four (or two) corner blocks 80.

The stabilizing elements 42, 44, may also be cooperative with the counterbores 103, 131 of the corner blocks 80, 110. In practice, such construction is suggested to stabilize corners of a wall. The elements 42, 44 would thus simultaneously cooperate with counterbores 103, 131 of a corner block 80, 110 and counterbores 70 or 72 of a modular block 40.

The described components and the mode of assembly of those components constitutes a preferred embodiment of the invention. It is to be noted that the corner blocks 80 as well as the standard modular blocks 40 may be combined in a retaining wall having various types of stabilizing elements and utilizing various types of analysis in calculating the bill of materials. That is, the stabilizing elements have both anchoring capabilities as well as frictional interactive capabilities with compacted soil or the like. Thus, there is a great variety of stabilizing elements beyond those specifically described which are useful in combination with the invention.

For example, the stabilizing elements may comprise a mat of reinforcing bars comprised of two or more parallel bars which are designed to extend into compacted soil. Rather than forming the loops on the ends of those bars to interact with vertical rods 46, it is possible to merely bend the ends of such rods at a right angle so that they will fit into the throughbores 62, 64 through the blocks 40 thereby holding mats or reinforcing bars in position. Additionally, the rods 46 may be directly welded to longitudinal tensile arms in the throughbores, thus, eliminating the necessity of forming a loop in the ends of the tension arms.

Though two tensions arms and thus two reinforcing bars are the preferred embodiment, a multiplicity of tension arms may be utilized. Additionally, as pointed out in the description above, the relative size of the corner blocks may be varied and the dimensional alternatives in that regard were described. The shapes of the rods 46 may be varied. The attachment to the rods 46 may be varied.

Figure 35:
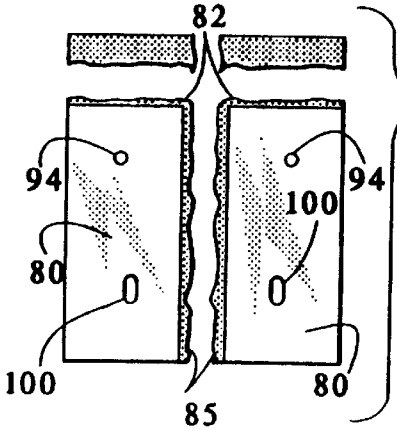
FIG. 35 is a plan view of corner blocks of FIG. 24 separated.
Figure 36:
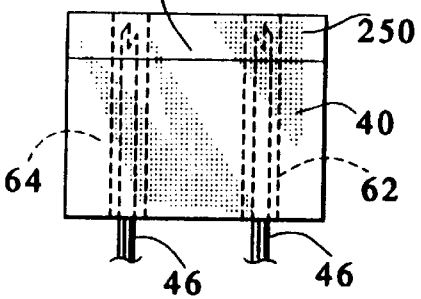
FIG. 36 is a front elevation of a wall construction with a cap block.
Figure 36A:
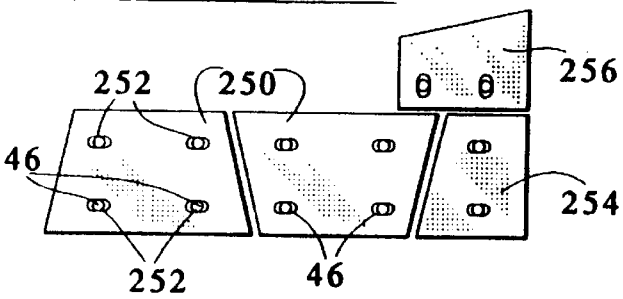
FIG. 36A is a top plan view of cap blocks forming a corner.

Also, cap blocks 250 may be provided as illustrated in FIGS. 35 and 36. Such blocks 250 could have a plan profile like that of modular blocks 40 but with a longer lateral dimension and four throughbores 252, which could be aligned in pairs with throughbores 62, 64. The cap blocks 250 may then be alternated in orientation, as depicted in FIG. 35, with rods 46 fitting in proper pairs of openings 252. Mortar in openings 252 would lock the cap blocks 250 in place. Cap blocks 250 could also be split into halves 254, 256, as shown in FIG. 35, to form a corner. An alternative cap block construction comprises a rectangular shaped cap with a longitudinal slot on the underside for receipt of the ends of rods 46 projecting from the top course of a row of blocks 40. Other constructions are also possible.

Figure 37:
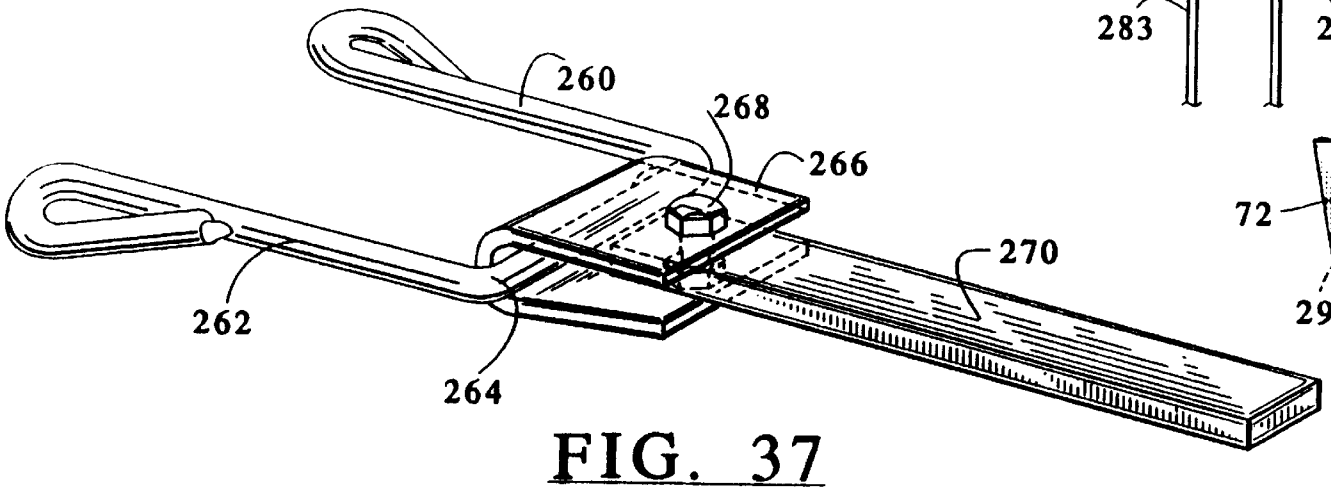
FIG. 37 is an isometric view of an alternative stabilizing element.

Another alternative construction for a stabilizing element is illustrated in FIG. 37. There, tension arms 260, 262 and cross members 264 cooperate with a clamp 266 which receives a bolt 268 to retain a metal strip 270. Strip 270 is designed to act as a friction strip or connect to an anchor (not shown).

Figure 38:
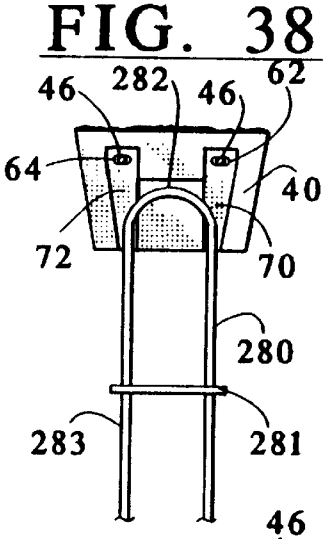
FIG. 38 is a bottom plan view of an alternative stabilizing element and wall block construction.

FIG. 38 depicts another alternative construction for a stabilizing element 280 and the connection thereof to block 40. Element 280 includes parallel tension arms 281, 283 with a cross member 282 which fits in the space between counterbores 70, 72 defined by passage 74. The shape of the walls defining the passage 74 may thus be molded to maximize the efficient interaction of the stabilizing element 280 and block 40.

Figure 39:
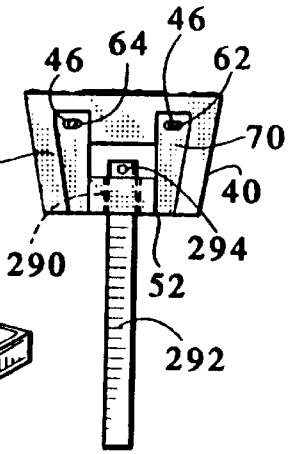
FIG. 39 is a plan view of another alternative stabilizing element and wall block construction.

FIG. 39 depicts yet another alternative construction wherein block 40 includes a passage 290 from internal passage 74 through the back face 52 of block 40. A stabilizing element such as a strip 292 fits through passage 290 and is retained by a pin 294 through an opening in strip 292. Strip 292 may be tied to an anchor (not shown) or may be a friction strip. Rods 46 still are utilized to join blocks 40.

Figure 41:
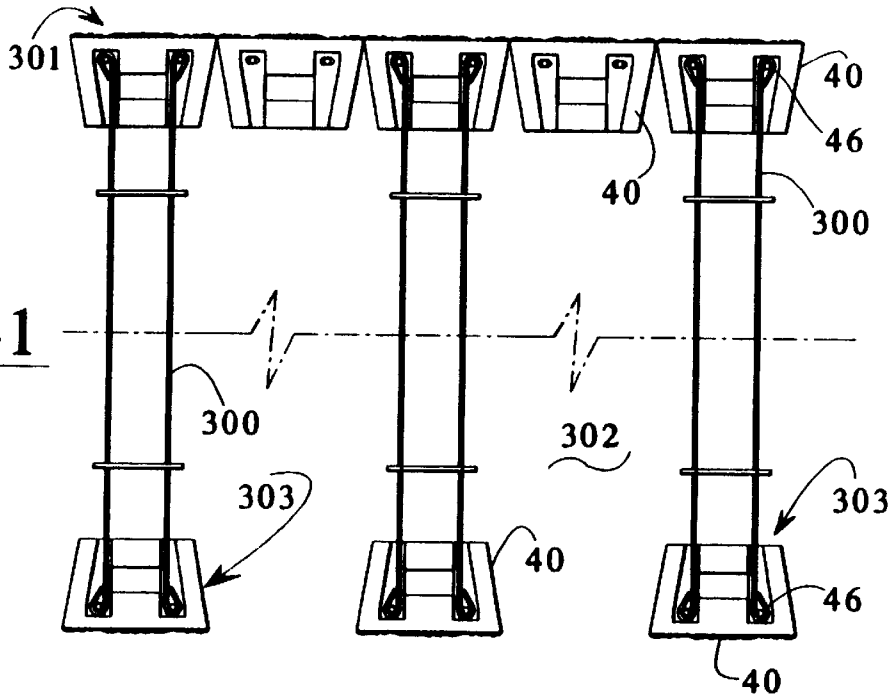
FIG. 41 is a bottom plan view of the wall construction of FIG. 40 taken along the line 41—41.

FIGS. 40 and 41 depict a wall construction comprised of blocks 40 in combination with anchor type stabilizing elements. The anchor type stabilizing elements are, in turn, comprised of double ended tensile elements 300 analogous to elements 42 previously described. The elements 300 are fastened to blocks 40 at each end by means of vertical rods 46. The blocks 40 form an outer wall 302 and an inner anchor 304 connected by elements 300. Anchors 304 are imbedded in compacted soil 305. The inside surface of the outer wall 302 may be lined with a fabric liner 306 to prevent soil erosion. This design for a wall construction utilizes the basic components previously described and may have certain advantages especially for low wall constructions.

Figure 42:
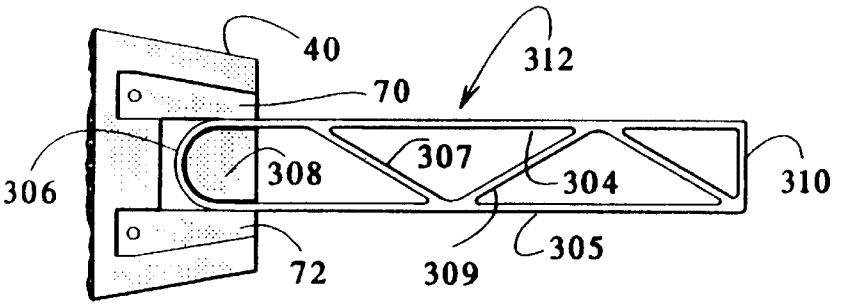
FIG. 42 is a top plan view of an alternative stabilizing element construction.
Figure 43:
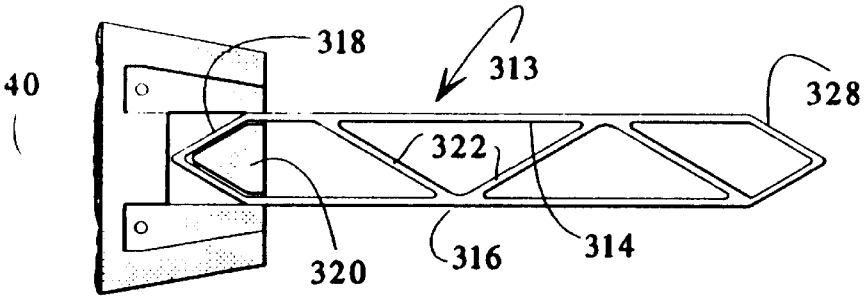
FIG. 43 is a top plan view of another alternative stabilizing element construction.
Figure 44:
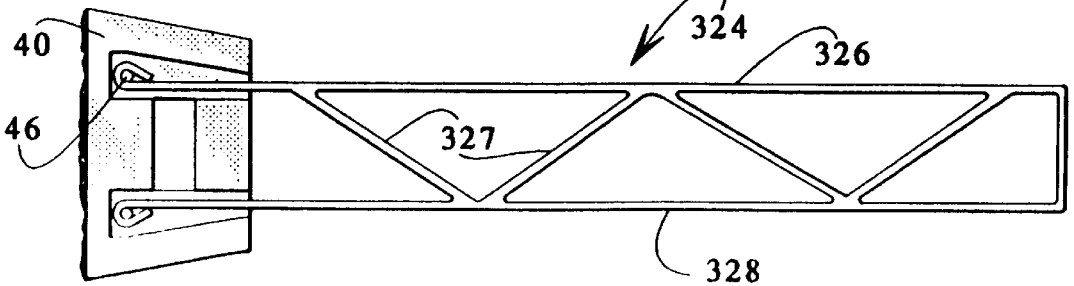
FIG. 44 is a top plan view of another stabilizing element construction.

FIGS. 42, 43 and 44 illustrate further alternative constructions for a stabilizing element 302 and a connection thereof to block 40. Reference is also directed to FIG. 38 which is related functionally to FIGS. 42, 43, and 44. Referring to FIG. 42, there is depicted a block 40 with a stabilizing element 302 comprised of first and second parallel arms 304 and 305 which are formed from a continuous reinforcing bar to thereby define an end loop 306 which fits over a formed rib 308 defined between the connected counterbores 70 and 72. This is analogous to the construction depicted in FIG. 38. The parallel arms or bars 304 and 305 are connected one to the other by cross members 307 and 309 which are connected to the arms 304 and 305 at an angle to thereby define a truss type construction. The ends of the arms 304 and 305 may be connected by a transverse, perpendicular cross member or cross brace 310.

Referring to FIG. 43, there is illustrated yet another alternative construction wherein a stabilizing element 312 is again comprised of parallel arms 314 and 316 which form a symmetrical closed loop construction including an end 318 having a generally V shape as depicted in FIG. 43 cooperative with a rib 320 defined in the block 40. Note that the cross members 322 are at an angle to define a truss type configuration. Further note that the V-shaped end 318 includes an opposite end counterpart 328 so that the entire stabilizing element 312 is generally symmetrical. It may or may not be symmetrical, depending upon desires.

FIG. 44 illustrates a variation on the theme of FIG. 43 wherein a stabilizing element 324 is comprised of arms 326 and 328 which cooperate with reinforcing bars 46 positioned in block 40 in the manner previously described. Crossing members 328 are again configured to define a generally truss shaped pattern analogous to the construction shown in FIGS. 42 and 43. Thus it can be seen that the construction of the stabilizing element may be varied significantly while still providing a rather rigid stabilizing element cooperative with blocks 40 and corner blocks as previously described.

Figure 46:
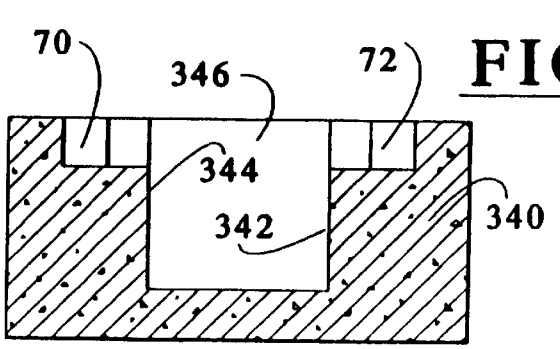
FIG. 46 is a cross-sectional view of the alternative cap block construction of FIG. 45 taken along the line 46—46.
Figure 45:
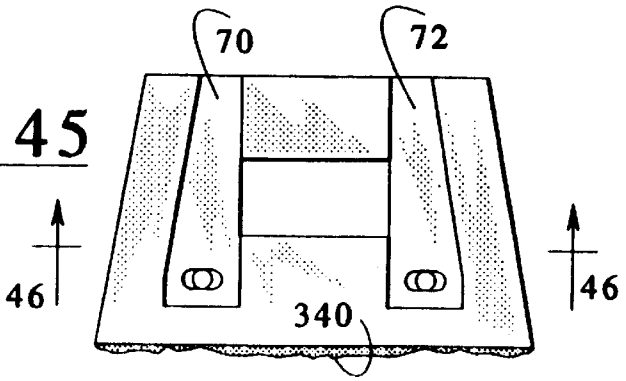
FIG. 45 is a bottom plan view of an alternative cap block construction.

FIGS. 45 and 46 illustrate an alternative to the cap block construction previously described. In FIG. 45, the bottom plan view of the cap block has substantially the same configuration as a face block 40. Thus cap block 340 includes counterbores 70 and 72 which are designed to be cooperative with stabilizing elements in the manner previously described. The passageways through the cap block 340, however, do not pass entirely through the block. Thus, as illustrated in FIG. 46, the cap block 340 includes counterbores 72 and 70 as previously described. A passageway for the reinforcing bars 46; namely, passage 342 and 344 extends only partially through the block 340. Similarly, the passage 346 extends only partially through the cap block 340. In this manner, the cap block 340 will define a cap that does not have any openings at the top thereof. The cap block 340 as depicted in FIGS. 45 and 46 may, when in a position on the top of the wall, have gaps between the sides of the blocks because of their tapered shape. Thus it may be appropriate and desirable to mold or cast the cap blocks in a rectangular, parallelpiped configuration as illustrated in dotted lines in FIG. 45. Alternatively, the space between the blocks 340 forming the cap may be filled with mortar or earthen fill or other fill.

Alternative Stabilizing Elements and Combinations

Figure 47:
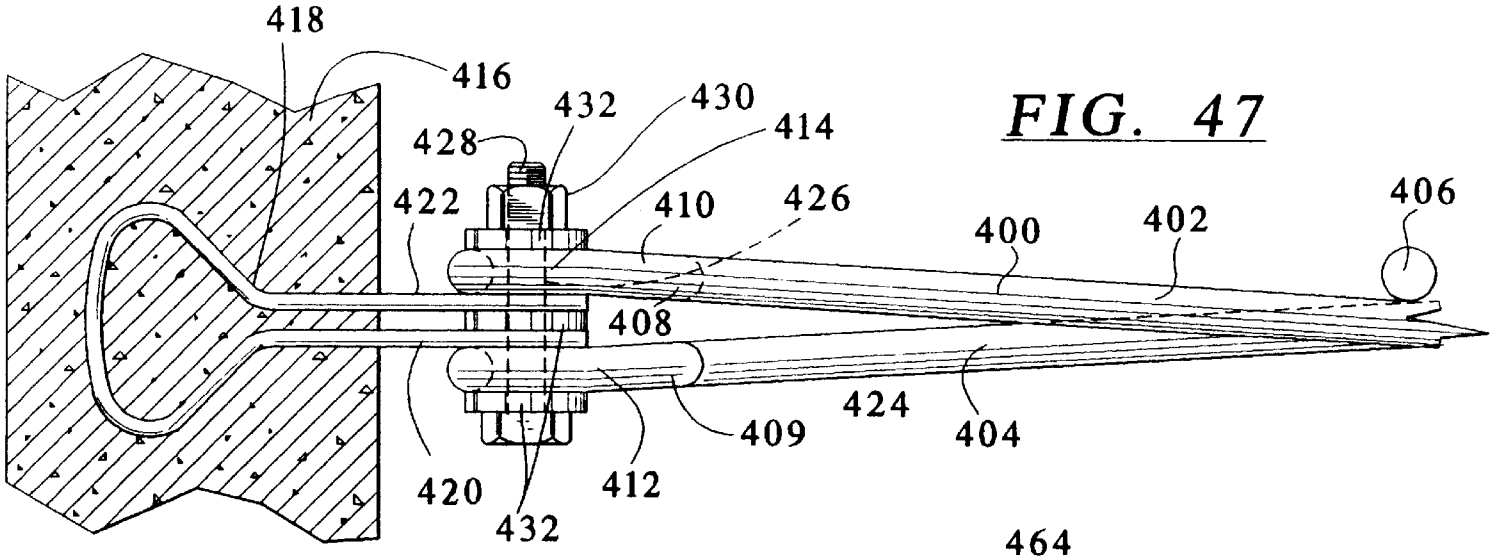
FIG. 47 is a side elevation of an alternative construction depicting a stabilizing element in combination with a precast wall panel and further illustrating a fastening assembly for fastening the stabilizing element to the panel.

Referring to FIG. 47, an alternative stabilizing element is depicted in combination with a precast wall panel. Specifically a stabilizing element 400, which is similar to such elements previously disclosed, includes a first horizontal run 402 and a second, coplanar, horizontal parallel run 404. Runs 402, 404 are spaced from one another by means of a crossbar 406 welded thereto. A series of cross bars 406 at spaced intervals are provided as with the construction of stabilizing elements previously described. Inner ends 408 and 409 of the stabilizing element 400 are formed as closed loops 410 and 412, again, as previously disclosed. These loops 410, 412, however, are positioned one over the other so that they define a vertical passage or opening 414. Thus the runs 402, 404 are bent toward one another so that loops 410, 412 overlie one another to define the opening 414.

A precast panel or block member or the like such as panel 416, includes a cast-in-place connecting member 418 projecting from the backside thereof as projecting tabs 420 and 422 having aligned, vertical passageways 424 and 426 therethrough. The passage or opening 414 associated with the looped ends 410 and 412 is aligned with the passageways 424 and 426. A bolt 428 is then vertically inserted through the aligned passage 414 and passageways 424, 426, and a nut 430 is attached to the threaded end of bolt 428. Washers, such as washers 432, may be positioned on bolt 428, as depicted, in order to ensure that the bolt 428 and nut 430 will not accidentally fall through the passage 414 or passageways, 424, 426. Attachment of the stabilizing element 400 to the member 418 is thus effected.

This same stabilizing element 400 may be attached to a strip or element such as an element 266 in FIG. 37 extending from a block 40 of the type previously described as in FIG. 2. Thus stabilizing element may be utilized in combination with a myriad of facing elements, including but not limited to, precast panels, blocks, wire grids and other facing elements.

Figure 48:
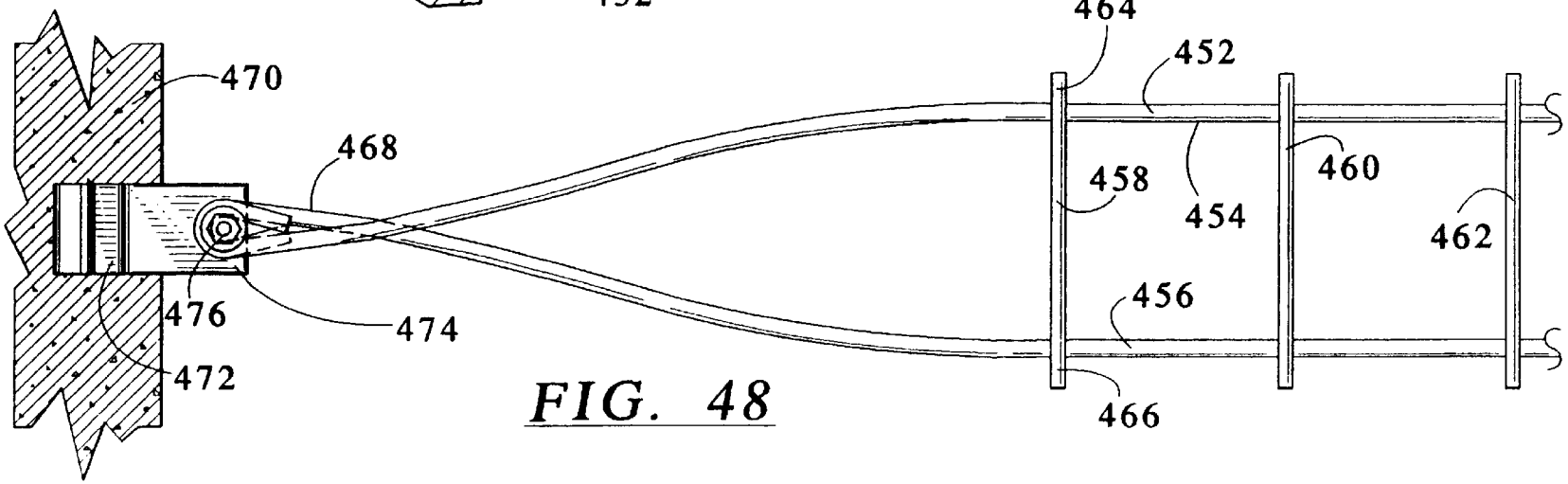
FIG. 48 is a top plan view of an assembly similar to that of FIG. 47.

Referring to FIG. 48, another alternative configuration of a stabilizing element is depicted. In FIG. 48, a stabilizing element 452 includes spaced generally parallel horizontal runs or rebars 454 and 456. The runs 454, 456 are spaced from one another and connected together by spaced generally parallel, horizontal cross members 458, 460 and 462. The cross members of 458, 460 and 462 are typically rods or reinforcing bars and are welded to the horizontal bars or longitudinal bars 454 and 456. The cross bars, such as cross bar 458, may extend laterally beyond the longitudinal bars 454 and 456, thereby defining projecting ends such as ends 464 and 466 in FIG. 48. The runs 454 and 456 connect or otherwise constitute a single, connected, reinforcing bar which defines a loop 468. The loop 468 in FIG. 48 is defined by the reinforcing bar which is bent and crosses over itself as depicted in FIG. 48. It is possible, however, to have the loop 468 open-ended, i.e., parallel runs 454, 456 connected by a crown or cross member.

The stabilizing element 452 is attached to a panel 470 having a cast in place connecting element 472 and one or more projecting tabs 474 in a manner similar to the connection construction in the embodiment depicted in FIG. 47. Thus, a bolt 476 co-acts with one or more of the tabs or elements 474. Also, the stabilizing element 452 of FIG. 48 may be utilized in combination with a strip or element such as element 266 in FIG. 37 for cooperative engagement with a block 40 of the type described and depicted in FIG. 2.

Figures 49, 51, 53:
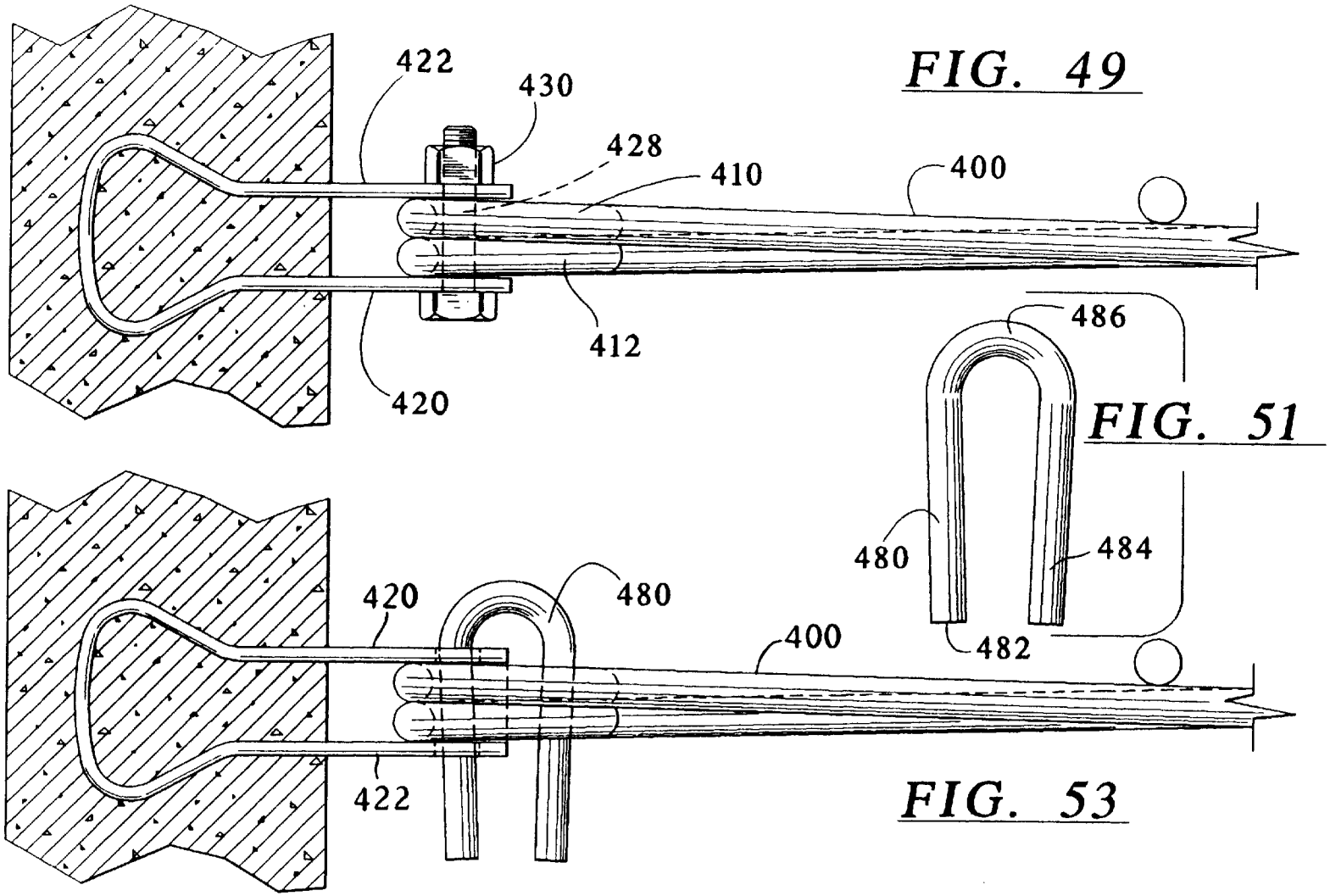
FIG. 49 is a side elevation of a further alternative assembly again similar to that of FIG. 47.
FIG. 51 is a plan view of the fastener element utilized in combination with the assembly of FIG. 50.
FIG. 53 is a side elevation of an assembly similar to that of FIG. 50 utilizing the substantially the same components assembled in a different configuration.

FIG. 49 depicts another alternative or variant of the embodiment disclosed in FIG. 47. Referring to FIG. 49, the stabilizing element 400 is designed with the looped ends 410 and 412 abutting or adjacent to one another so that the bolt 428 and cooperative nut 430 may be fitted through the tabs 420 and 422 and ends 410, 412 retained between those tabs 420 and 422. Alignment of the looped ends 410 and 412 and co-action thereof with the bolt 428 and nut 430 is somewhat simplified by this arrangement relative to that of FIG. 47 inasmuch as the tabs 420 and 422 assume the role of the washers such as the washers 432 in FIG. 47. Fewer parts are required for the preferred embodiment of this assembly.

Figure 50:
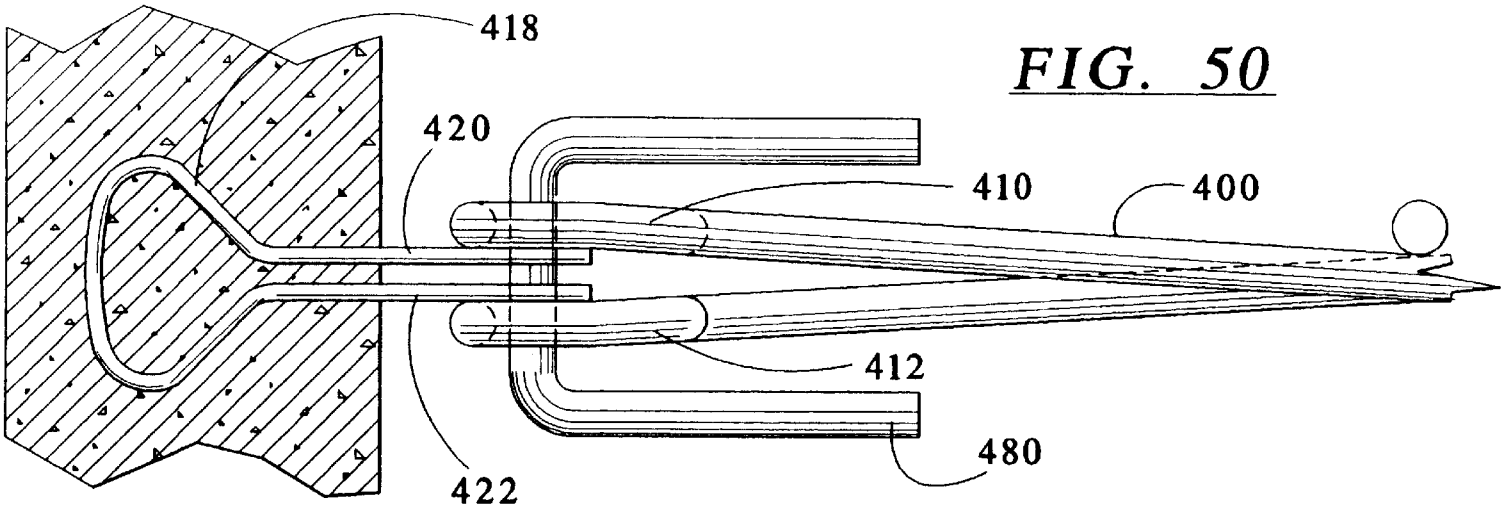
FIG. 50 is a side elevation of yet another assembly similar to that of FIG. 47 incorporating a further mechanism for attaching a stabilizing element to a panel, block or wall member.
Figure 52:
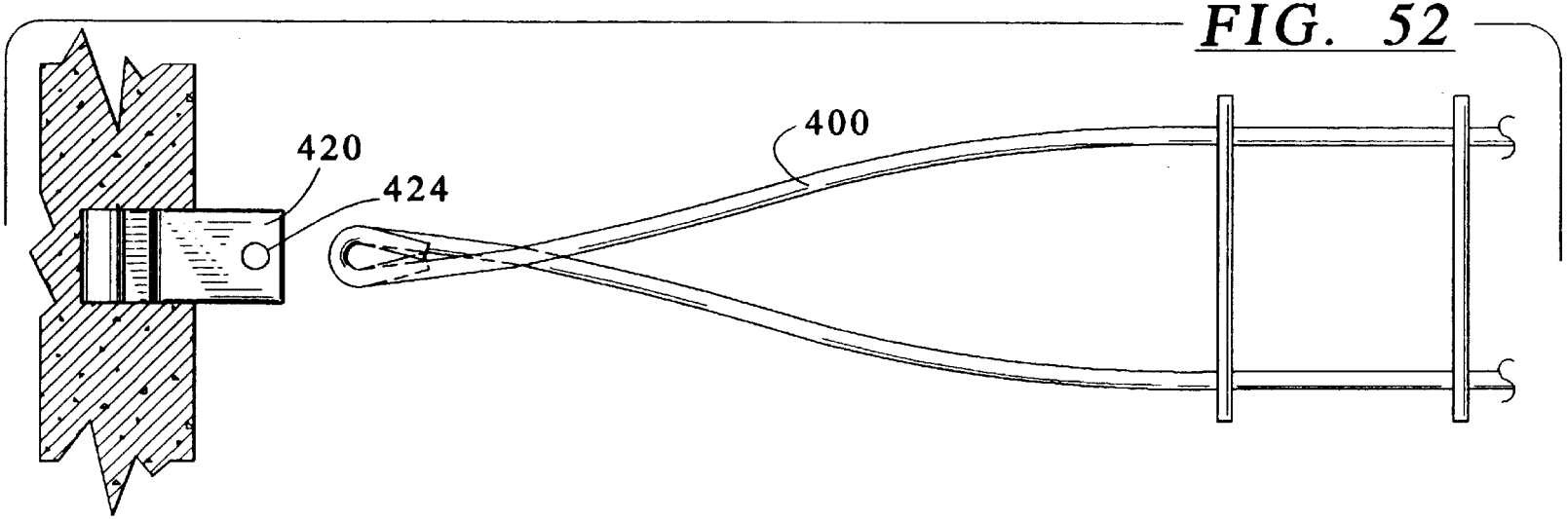
FIG. 52 is a top plan view of certain component parts of FIG. 50 prior to assembly.

FIGS. 50 through 52 illustrate an alternative variation or configuration of the means and assembly for connecting a stabilizing element, such as stabilizing element 400, to a connecting member such as connecting member 418 and, more particularly to the tabs 420 and 422. Thus, referring to FIG. 50, the stabilizing element 400 is attached to or co-acts with the connecting element 418 and more particularly the tabs 420 and 422 by means of a U-shaped fastener or clip 480 which is also made of a metal material. For example, the clip 480 may be a steel, U-shaped or horseshoe-shaped member as depicted in FIG. 51. The clip 480 thus includes generally parallel, spaced legs 482 and 484 connected by an arcuate or curved crown 486.

The clip or fastener or connector 480 fits through the openings or passageways 424 and 426 in the projecting tabs 420 and 422 as well as through the looped ends 410 and 412 as depicted in FIG. 50. The preferred final orientation of the fastener 480 is depicted in FIG. 50. FIG. 52 is a top-plan view depicting the manner by which the stabilizing element 400 may be positioned in cooperation with the projecting tabs 420 and 422 so as to align passage 414 with passageways 424 and 426. FIG. 53 depicts the first step when connecting the element 400 to the member 418 by means of the fastener or connector 480. Thus a leg 482 of the connector 480 may be initially inserted through the associated passage 414 and passageways 424, 426. The connector 480 may then be left in the position depicted in FIG. 53 or alternatively further manipulated so as to assume the configuration of FIG. 50. The configuration of the connector 480 may also be altered to facilitate assembly. For example, it may be more U-shaped than depicted in the FIG. 53. Also, the crown 486 may be flatter or more arcuate. Many variants of the shape of the clip 480 may be provided.

Figure 54:
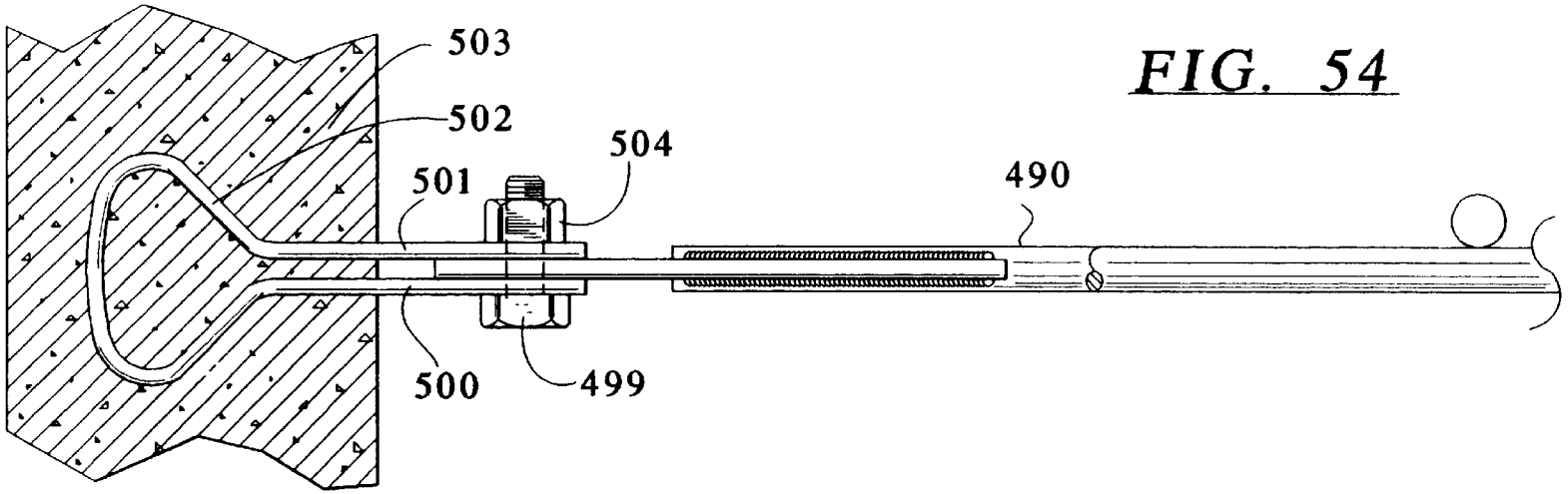
Figure 55:
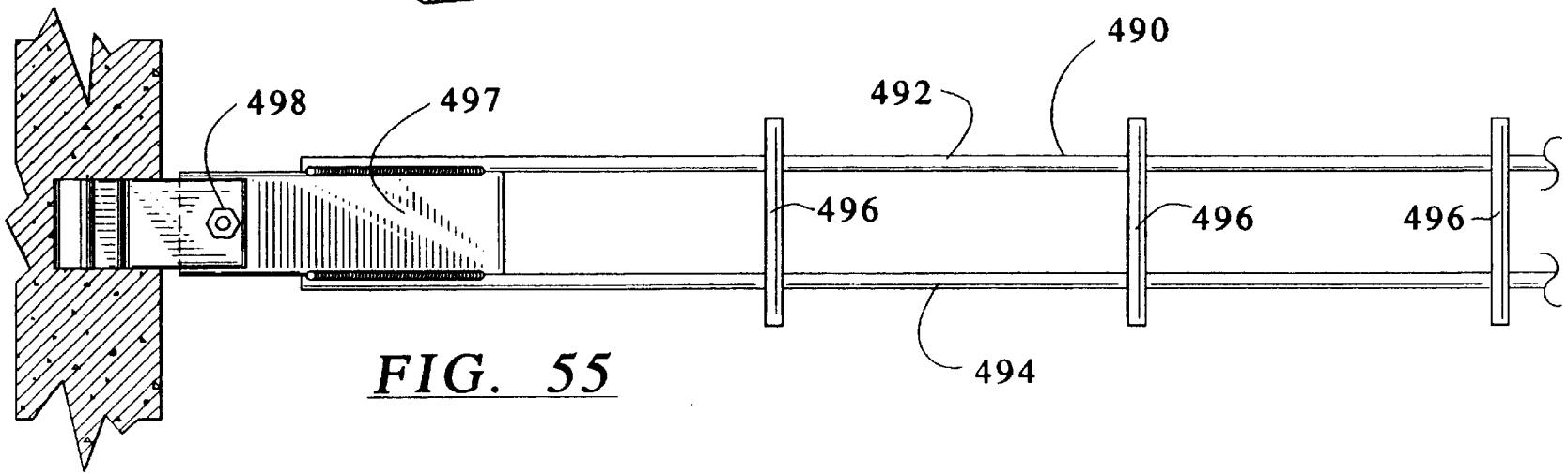
FIG. 55 is a top plan view of the assembly FIG. 54.

FIG. 54 discloses yet another variant of a stabilizing element. Stabilizing element 490 is comprised, as depicted in FIGS. 54 and 55, of generally parallel horizontal and longitudinally extending reinforcing members, bars or rods 492 and 494. The members or rods 492 and 494 are spaced from one another and connected by cross members or cross bars 496 in the manner previously described. The rods or longitudinal members 492 and 494 are spaced typically about two inches (2") apart.

In the embodiment shown, the rods 492 and 494 are welded to a planer plate 497. The planer plate 497 is generally rectangular in configuration and the rods 492 and 494 are welded to the lateral parallel spaced edges of the plate 497. The plate 497 includes a passage or opening 498 through one end. The plate 497 may thus be attached by means of a bolt 499 through parallel spaced projecting tabs 500 and 501 of a cast-in-place retaining element 502. The retaining element 502 is cast in place in a pre-existing pre-cast concrete facing panel 503. The bolt 499 is then retained in position by means of a nut 504.

Again, the configuration of the stabilizing element 490 depicted in FIGS. 54 and 55 may be utilized in combination with an attachment element such as the element 266 in FIG. 37. The element 266 may co-act with a block 40 of the type previously described. The plate 497 may also be connected to a block 40 in the manner depicted in FIG. 39 wherein plate 497 passes through a slot 290 and is held by a pin 294. The stabilizing element 490 may also be utilized in combination with numerous types of facing elements including panels such as panel 503, blocks such as blocks 40, and wire facing panels.

Figure 56:
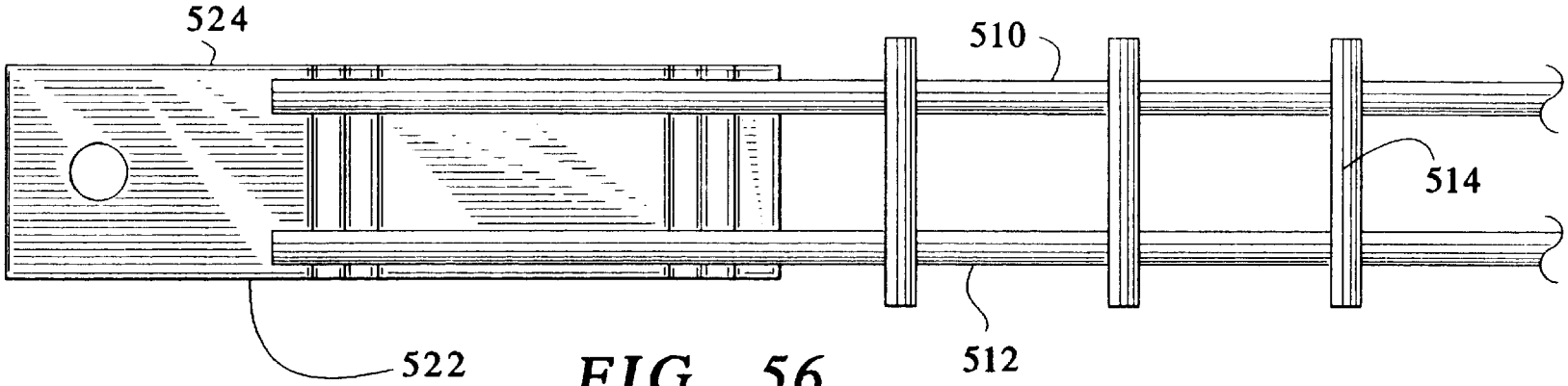
FIG. 56 is a top plan view of an alternative stabilizing element of the type that can be utilized in combination with the assembly of FIG. 54 and various other types of assemblies utilizing wall blocks, precast facing elements and other types of facing elements.
Figure 57:
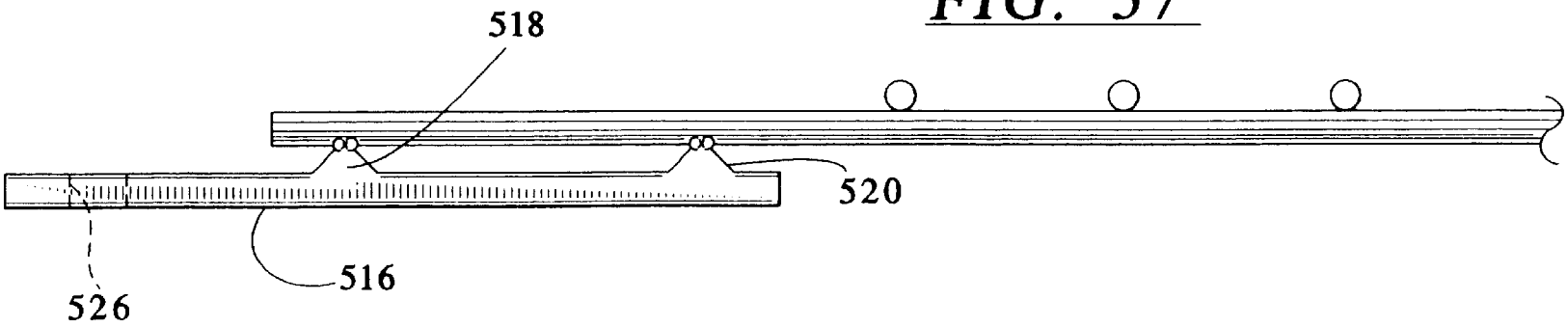
FIG. 57 is a side elevation of the stabilizing element of FIG. 56.

FIGS. 56 and 57 illustrate an alternative construction for a stabilizing element which is a variation of the type shown in FIGS. 54 and 55. The variation of FIGS. 56 and 57 includes parallel, horizontal bars or rods 510 and 512 which are spaced one from the other by means of cross bars such as cross bar 514. A plate 516 is a generally planer plate and includes upwardly projecting, spaced, parallel ribs 518 and 520. The ribs 518 and 520 typically are cross ribs which connect between the opposite sides 522 and 524 of the plate 516. In this manner, the parallel longitudinal rods 510 and 512 may be welded to the ribs 518 and 520 as depicted in FIG. 57. The plate 516 also includes a through passage 526. The passage 526 enables the stabilizing element, depicted in FIGS. 56 and 57, to be attached to wall panels, blocks, wire facing elements and other elements in a manner such as depicted in FIG. 54, 55, 37 or 39 for example.

Figure 58:
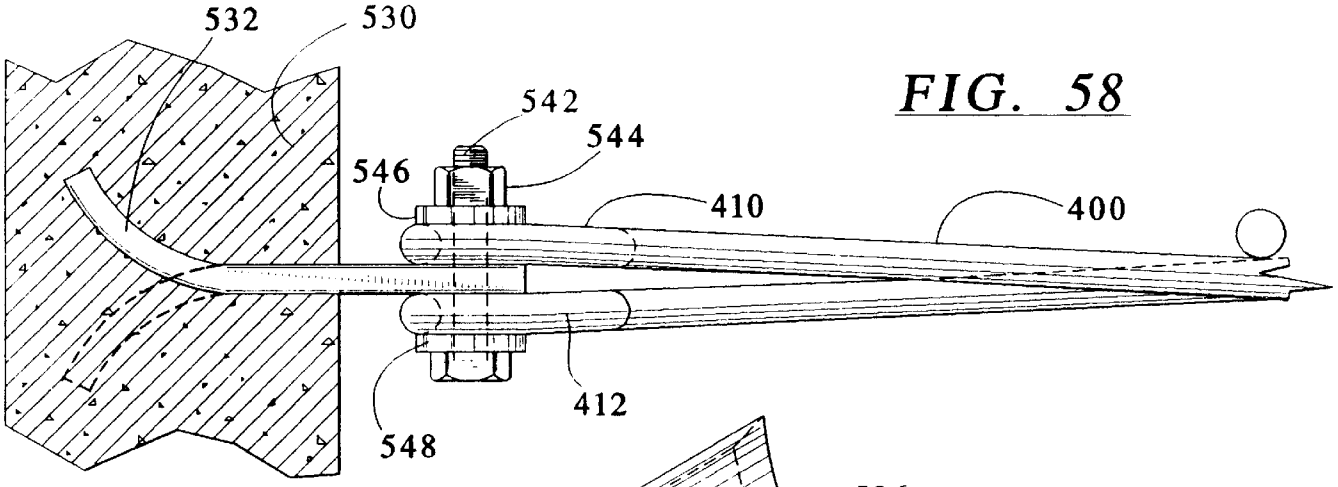
FIG. 58 is a perspective of a stabilizing element of the type depicted in FIG. 47, for example, and in combination with a wall panel and an alternative connector or tab construction cast in place in the wall panel.
Figure 59:
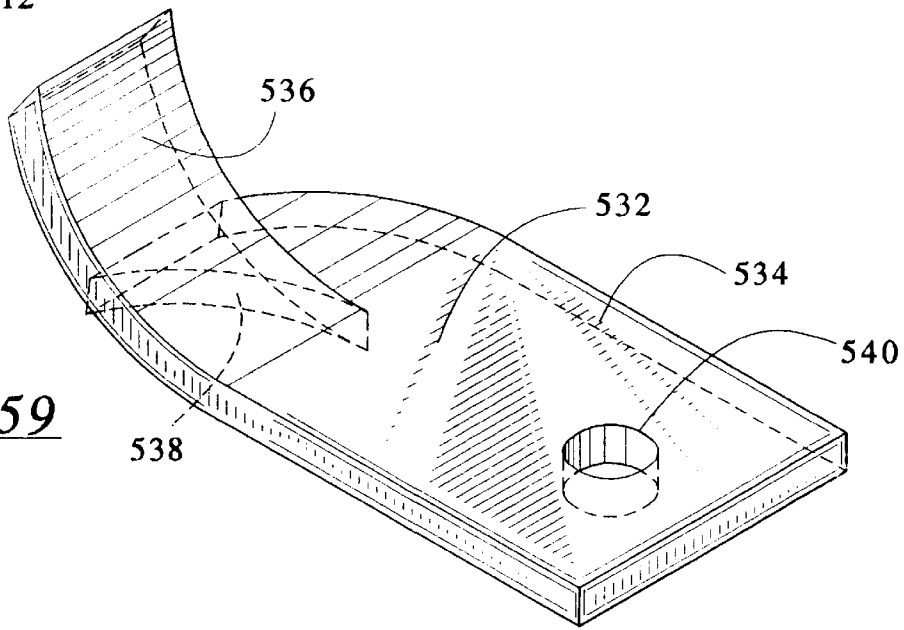
FIG. 59 is an isometric view of the tab construction cast in place in the wall panel depicted in FIG. 58.

FIG. 58 depicts a wall panel 530 which is a precast wall panel having a tab or attachment plate construction 532 cast in place therein. As depicted in FIG. 59, the plate 532 includes a flat tab section 534 and wing sections 536 and 538 which are cast in the panel 530. A through passage 540 in the plate 534 permits receipt of a fastener bolt 542 for attachment of the looped ends 410 and 412 of stabilizing element 400 previously described. A nut 544 is threaded on the bolt 542 and washers 546 and 548 assist in retention of the stabilizing element 400 on the connector 532.

Figure 60:
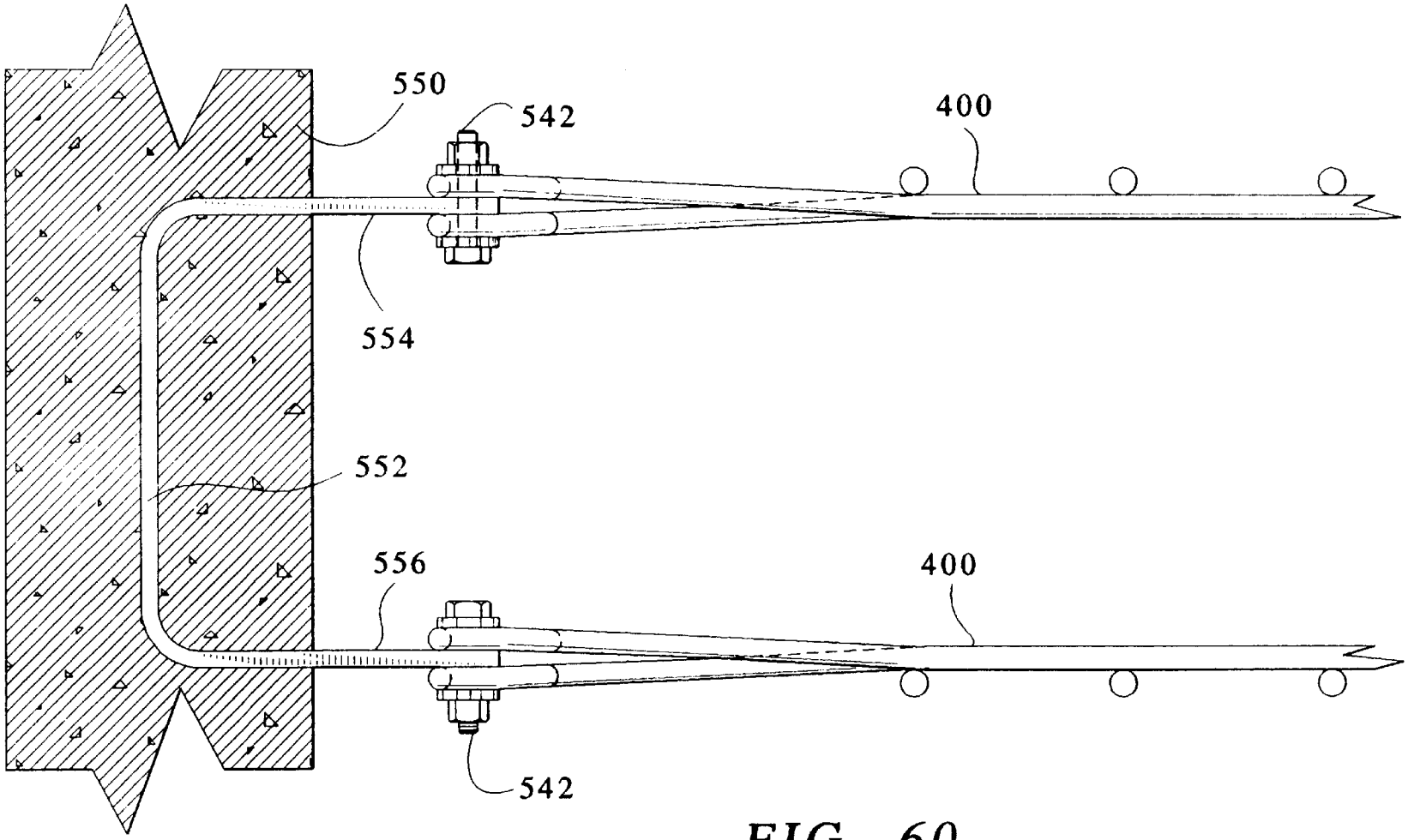
FIG. 60 is a side elevation of an alternative cast in place wall panel and tab construction.

FIG. 60 illustrates an alternative construction for a precast facing panel which is useful for connection to stabilizing elements 400. Thus, a cast in place panel 550 includes a metal strip 552 having opposite ends 554 and 556 projecting from the cast in place panel 550. The ends 554 and 556 each include a through passage adapted for receipt of a bolt 542 which retains the stabilizing elements 400 attached to the wall panel 550 in the same manner as described with respect to FIG. 58.

Figure 61:
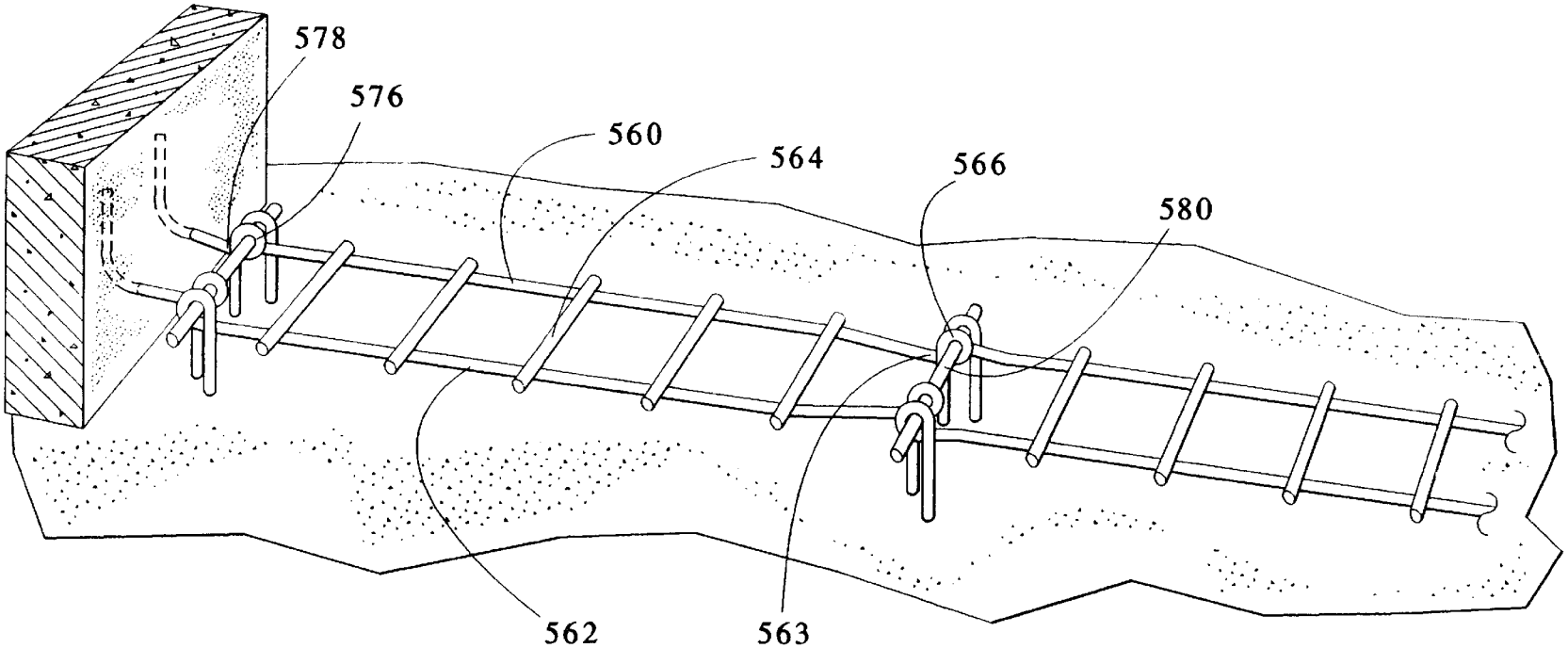
FIG. 61 is a perspective view of an alternative stabilizing element configuration in combination with a cast in place fastening construction for attaching the stabilizing element to a wall panel and further for attaching segments or sections of stabilizing elements.
Figure 62:
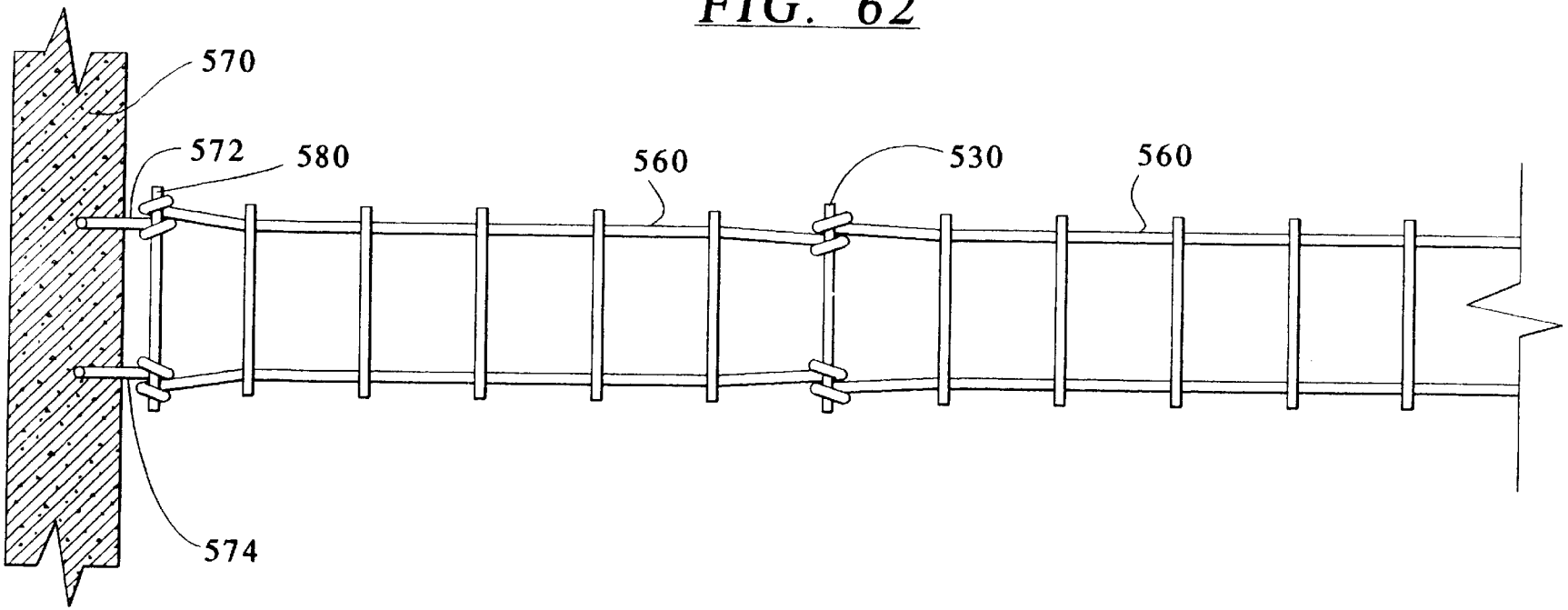
FIG. 62 is a top plan view of the construction of FIG. 61.

FIG. 61 and FIG. 62 together illustrate another alternative construction for a stabilizing element as well as a connection construction for attachment of the stabilizing element to a precast wall panel, for example. Referring to those figures, therefore, the stabilizing element includes first and second parallel spaced rods or reinforcing bars 560 and 562 which are designed to extend longitudinally and generally horizontally into an earthen work bulk form. The bars 560 and 562 are connected by cross members or cross bars or cross rods 564, for example. At each end of each of the separate horizontal bars 560 and 562, include a vertical loop. Thus, bar 562 includes a vertical loop 566. The vertical loop is thus formed by bending the ends of the rod 562 and forming a closed loop. The closed loop may be welded at the juncture crossover point 568 of the end of the rod 562.

Each end of the rod 562 and each end of the rod 564 is formed in the manner described. Further, the precast wall panel 570 includes rods 572 and 574 cast in place therein. The rods 572 and 574 also project from the panel 570 and are formed in a closed loop 576. Again where the closed loop folds over itself or has a crossover point 578, the rod may be welded to insure a good secure connection. The loops 566 and 576 may then be aligned with one another and a tie bar or cross member 580 is inserted through the aligned loops. The cross member 580 may thus connect the stabilizing element 560 to the connecting members 572 and 574. Additionally, the stabilizing elements 560 may be connected to one another in the same manner utilizing a cross bar 580. The cross bar 580 in the embodiment shown is a straight cross bar member. However, various combinations of such a connector may be utilized. For example, the cross bar 580 may constitute a bar having legs and a crown. The cross bar may have legs which are folded over on one another after being inserted through the loops 566 and/or 576. As depicted, a number of stabilizing elements 560 may be attached on to the other. The stabilizing elements 560 may also be connected to various other types of facing elements including blocks and wire facing elements.

Other variants of the stabilizing element construction, as well as variants of the connectors of the stabilizing elements to certain wall elements such as precast panels, blocks, wire mesh facing elements and the like are possible. Thus the invention is to be limited only by the following claims and their equivalents.

What is claimed is:

1. An improved stabilizing element for use in combination with a facing member in a mechanically stabilized earthen structure comprising, in combination:

first and second generally parallel, horizontal rod members, said first and second rod members spaced from one another by connecting, attached cross members, said first and second rod members each having an inner end for positioning adjacent a facing member in a mechanically stabilized earthen structure and an outer end, the inner ends being connected together to define a closed, horizontal loop defining a passage for a fastener through the horizontal loop for connection of the stabilizing element to a facing member.

2. The stabilizing element of claim 1 in combination with a facing member, said facing member including a back surface with a projecting connector, said connector including a vertical passage therethrough aligned with the vertical passage of the stabilizing element; and a fastener extending through the aligned passages to connect the stabilizing element to the facing member.

3. The combination of claim 2 wherein the fastener is comprised of a clip member having two generally parallel spaced legs connected by a crown, wherein the fastener is inserted into the passages by extending one leg therethrough.

4. The combination of claim 2 wherein the fastener is comprised of a bolt with a head and having a shaft extending from the head vertically downward through the passages.

5. An improved stabilizing element for use in combination with a facing member in a mechanically stabilized earthen structure comprising, in combination:

first and second generally parallel, horizontal rod members, said first and second rod members spaced from one another by connecting, attached cross members, said first and second rod members each having an inner end for positioning adjacent a facing member in a mechanically stabilized earthen structure and an outer end, each of said inner ends formed as a horizontal loop to define a separate passage for positioning a fastener therethrough to connect the stabilizing element to a facing member.

6. The stabilizing element of claim 5 where in the horizontal loops overlie one another to define a single vertical pathway for a fastener extending vertically through the overlying horizontal loops.

7. An improved stabilizing element for use in combination with a facing member in a mechanically stabilized earthen structure comprising, in combination:

first and second generally parallel, horizontal rod members, said first and second rod members lying in a horizontal plane and spaced from one another by connecting cross members, each rod member having an inner end for positioning adjacent a facing member in a mechanically stabilized earthen structure and an extended outer end for extending into backfill material to engage the backfill material in a mechanically stabilized earthen structure;

a single horizontal plate member attached to both the first and second rods at the inner ends and connecting the inner ends, said horizontal plate member including a vertical passage therethrough for receipt of a fastener to connect the stabilizing element to a facing member in a mechanically stabilized earthen structure.

8. The stabilizing element of claim 7 wherein the plate member is comprised of a plate member having at least one raised rib member on a surface of the plate, and wherein the rod members are fastened to the raised rib member.

9. The stabilizing element of claim 8 wherein the plate member includes at least two raised rib members on the same surface of the plate member, and wherein each of the rod members is attached to the raised rib members.

10. An improved stabilizing element for use in combination with a facing member in a mechanically stabilized earthen structure comprising, in combination:

first and second generally parallel, horizontal rod members, said first and second rod members spaced from one another by connecting, attached cross members, said first and second rod members each having an inner end for positioning adjacent a facing member in a mechanically stabilized earthen structure and an outer end, each of said inner ends formed as a horizontal loop to define a separate passage for positioning a fastener therethrough to connect the stabilizing element to a facing member, said horizontal loops overlying one another to define a pathway for a fastener therethrough.

11. A stabilizing element in combination with a facing member in a mechanically stabilized earthen structure comprising, in combination:

a facing member having a back surface with a projecting connector, said connector including a vertical passage;

a stabilizing element including first and second generally parallel, horizontal rod members, said first and second rod members spaced from one another by connecting, attached cross members, said first and second rod members each having an inner end for positioning adjacent a facing member in a mechanically stabilized earthen structure and an outer end, the inner ends being connected together to define a closed, horizontal loop defining a passage for a fastener through the horizontal loop for connection of the stabilizing element to a facing member; and a fastener comprising a clip member having two, generally parallel, spaced legs connected by a crown, said fastener being inserted into the connector passage and stabilizing element passage to connect the stabilizing element to the facing member.

* * * * *